US012059597B2

(12) United States Patent
Adams et al.

(10) Patent No.: US 12,059,597 B2
(45) Date of Patent: Aug. 13, 2024

(54) COLLAPSIBLE DUAL-TRANSVERSE BAR PORTABLE PHYSICAL THERAPY PARALLEL BAR SYSTEMS

(71) Applicant: WAREOLOGIE, INC., Northville, MI (US)

(72) Inventors: Gina Rae Adams, Northville, MI (US); David Wells, Chicago, IL (US)

(73) Assignee: WAREOLOGIE, INC., Northville, MI (US)

( * ) Notice: Subject to any disclaimer, the term of this patent is extended or adjusted under 35 U.S.C. 154(b) by 172 days.

(21) Appl. No.: 17/865,063

(22) Filed: Jul. 14, 2022

(65) Prior Publication Data

US 2023/0019254 A1 Jan. 19, 2023

Related U.S. Application Data

(60) Provisional application No. 63/221,631, filed on Jul. 14, 2021.

(51) Int. Cl.
*A63B 3/00* (2006.01)
*A63B 22/00* (2006.01)

(52) U.S. Cl.
CPC ..... *A63B 3/00* (2013.01); *A63B 22/0002* (2013.01); *A63B 2210/50* (2013.01)

(58) Field of Classification Search
CPC ... A63B 3/00; A63B 22/0002; A63B 2210/50; A63B 23/0464
See application file for complete search history.

(56) References Cited

U.S. PATENT DOCUMENTS 3,747,233 A * 7/1973 Berryman ..... A63B 23/0464 434/255
4,415,150 A * 11/1983 Iezza ..... A63B 3/00 248/165
4,696,470 A * 9/1987 Fenner ..... A63B 1/00 482/17
4,902,000 A * 2/1990 Starks ..... A63B 3/00 482/904
6,162,061 A * 12/2000 Taylor ..... A63B 69/18 482/27
6,168,548 B1 * 1/2001 Fleming ..... A63B 3/00 482/41
6,238,320 B1 * 5/2001 Flanagan ..... A63B 3/00 482/130
10,058,723 B2 * 8/2018 Nickel ..... A63B 23/0464
(Continued)

*Primary Examiner* — Andrew S Lo
(74) *Attorney, Agent, or Firm* — Aurora Consulting LLC; Ashley Sloat; Ty F. Davis

(57) ABSTRACT

The present invention is directed to a physical therapy device capable of folding into a single portable device comprising a frame comprising a first lengthwise bar and a second lengthwise bar; and a first transverse bar and a second transverse bar. The frame is configured to be adjusted between an unfolded configuration for use and a folded configuration for storage; a first set of stanchions, each coupled to at least a portion of the first lengthwise bar; and a first handrail coupled to a top portion of each of the first set of stanchions. In the folded configuration, the first lengthwise bar is parallel to the second lengthwise bar, and the first and second transverse bars are configured to hinge such that each bar folds towards a center region of the frame to be substantially parallel to the first and second lengthwise bars.

20 Claims, 28 Drawing Sheets

(56) References Cited

U.S. PATENT DOCUMENTS

| | | | | |
|---|---|---|---|---|
| 10,252,095 | B1 * | 4/2019 | Carnahan | A63B 3/00 |
| 10,843,022 | B2 | 11/2020 | Carnahan et al. | |
| 11,173,335 | B2 * | 11/2021 | Horne | A63B 22/00 |
| 11,813,216 | B1 * | 11/2023 | Riess | A61G 7/1051 |
| 2002/0035016 | A1 * | 3/2002 | Weiss | A63B 3/00 482/34 |
| 2014/0087920 | A1 * | 3/2014 | Nickel | A63B 3/00 482/41 |
| 2023/0096295 | A1 * | 3/2023 | Sanders | A63B 3/00 482/41 |

* cited by examiner

COLLAPSIBLE DUAL-TRANSVERSE BAR PORTABLE PHYSICAL THERAPY PARALLEL BAR SYSTEMS

CROSS-REFERENCE TO RELATED APPLICATIONS

This application claims the priority benefit of U.S. Provisional patent application Ser. No. 63/221,631, filed Jul. 14, 2021, the contents of which are herein incorporated by reference in their entirety.

INCORPORATION BY REFERENCE

All publications and patent applications mentioned in this specification are herein incorporated by reference in their entirety, as if each individual publication or patent application was specifically and individually indicated to be incorporated by reference in its entirety.

TECHNICAL FIELD

This disclosure relates generally to the field of physical therapy, and more specifically, to the field of ambulation physical therapy and rehabilitation. Described herein are systems and methods for retracting and folding the physical therapy device for easy portability and compact storage.

BACKGROUND

Physical therapy and rehabilitation devices are used to assist users in regaining strength, balance, gait, and coordination. For physical therapy and rehabilitation patients to gain the confidence needed to pursue recovery of the preceding abilities, they must have complete confidence in the support device utilized. Traditionally, users are transported to offices, clinics, or specialized rooms where the physical therapy devices are assembled and remain stationary for a therapy session.

What is needed, therefore, is a more convenient, portable device that does not require the user to travel. It is critical that these devices do not sacrifice the essential rigid and secure features of stationary devices due to their portability.

SUMMARY

One aspect of the present disclosure is directed to a physical therapy device capable of folding into a single portable device. The physical therapy device comprises: a frame comprising a first lengthwise bar and a second lengthwise bar; and a first transverse bar and a second transverse bar; a first set of stanchions, each coupled to at least a portion of the first lengthwise bar; and a first handrail coupled to a top portion of each of the first set of stanchions.

In any of the preceding embodiments, the frame is configured to be adjusted between an unfolded configuration for use and a folded configuration for storage.

In any of the preceding embodiments, in the unfolded configuration: the first lengthwise bar is parallel to the second lengthwise bar, the first transverse bar is parallel to the second transverse bar, the first transverse bar is perpendicular to the first and second lengthwise bars, and the second transverse bar is perpendicular to the first and second lengthwise bars.

In any of the preceding embodiments, in the folded configuration: the first lengthwise bar is parallel to the second lengthwise bar, the first transverse bar is configured to hinge at a first position along its length such that the first transverse bar folds towards a center region of the frame to be substantially parallel to the first and second lengthwise bars, and the second transverse bar is configured to hinge at a second position along its length, such that the second transverse bar folds towards the center region of the frame to be substantially parallel to the first and second lengthwise bars.

In any of the preceding embodiments, the device further comprises a second set of stanchions, each coupled to at least a portion of the second lengthwise bar.

In any of the preceding embodiments, the device further comprises a second handrail coupled to a top portion of each of the second set of stanchions.

In any of the preceding embodiments, the first handrail is parallel to the second handrail.

In any of the preceding embodiments, one or more of the first set of stanchions is vertically adjustable.

In any of the preceding embodiments, each of the first set of stanchions comprises an external member and an internal member such that the internal member is configured to slide within a lumen defined by the external member for the vertical adjustment.

In any of the preceding embodiments, the device further comprises a platform comprising at least one base panel, wherein the at least one base panel comprises an outer edge that is rotatably coupled to the first lengthwise bar.

In any of the preceding embodiments, in the unfolded configuration, the at least one base panel is configured to rest on the frame, such that the at least one base panel is parallel to the frame.

In any of the preceding embodiments, in the folded configuration, the at least one base panel is rotated toward the first set of stanchions, such that the outer edge of the at least one base panel is configured to rest on the first lengthwise bar.

In any of the preceding embodiments, the first set of stanchions each comprises a width extender, such that the first handrail is configured to be adjusted relative to the first set of stanchions in a plane perpendicular to the first set of stanchions.

In any of the preceding embodiments, the device further comprises a wheel coupled to the frame, wherein the wheel is configured to be retracted toward the frame in the folded configuration and extended away from the frame in the unfolded configuration.

In any of the preceding embodiments, the device further comprises one or more stability supports operatively coupled to the first lengthwise bar.

In any of the preceding embodiments, in the unfolded configuration, the one or more stability supports are configured to extend from the frame to be substantially perpendicular to the first lengthwise bar.

Another aspect of the present disclosure is directed to a method of manipulating a portable physical therapy device between a folded configuration and an unfolded configuration. The method comprises: erecting a first set of stanchions each coupled to at least a portion of a first lengthwise bar, wherein the first set of stanchions are coupled to a first handrail at the top portion of each stanchion; and unfolding a frame.

In any of the preceding embodiments, unfolding the frame comprises unfolding a first transverse bar about a hinge positioned along its length such that the first transverse bar folds away from a center region of the frame to be substantially perpendicular to the first and second lengthwise bars, and unfolding a second transverse bar about a hinge positioned along its length such that the second transverse bar folds away from a center region of the frame to be substantially perpendicular to the first and second lengthwise bars.

In any of the preceding embodiments, the method further comprises erecting a second set of stanchions, each coupled to at least a portion of a second lengthwise and each having a top portion coupled to a second handrail.

In any of the preceding embodiments, the method further comprises vertically adjusting the first set of stanchions comprising an external member and an internal member such that the internal member is configured to slide within a lumen defined by the external member.

In any of the preceding embodiments, the method further comprises folding the frame, which comprises: folding a first transverse bar about a hinge positioned along its length such that the first transverse bar folds toward a center region of the frame to be substantially perpendicular to the first and second lengthwise bars; folding a second transverse bar about a hinge positioned along its length such that the second transverse bar folds toward a center region of the frame to be substantially perpendicular to the first and second lengthwise bars; and preserving the substantially parallel relationship between the first lengthwise bar and the second lengthwise bar.

In any of the preceding embodiments, the method further comprises rotating at least one base panel, comprising an outer edge that is rotatably coupled to the first lengthwise bar, to a position parallel to the first stanchions and is configured to rest upon the first lengthwise bar.

In any of the preceding embodiments, the method further comprises rotating at least one base panel, comprising an outer edge that is rotatably coupled to the first lengthwise bar, to a position substantially parallel to the frame; and resting the at least one base panel on the frame.

In any of the preceding embodiments, the method further comprises maneuvering at least one stability support, operatively coupled to the first lengthwise bar, outward and away from the first lengthwise bar

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying drawings.

Figure 1:
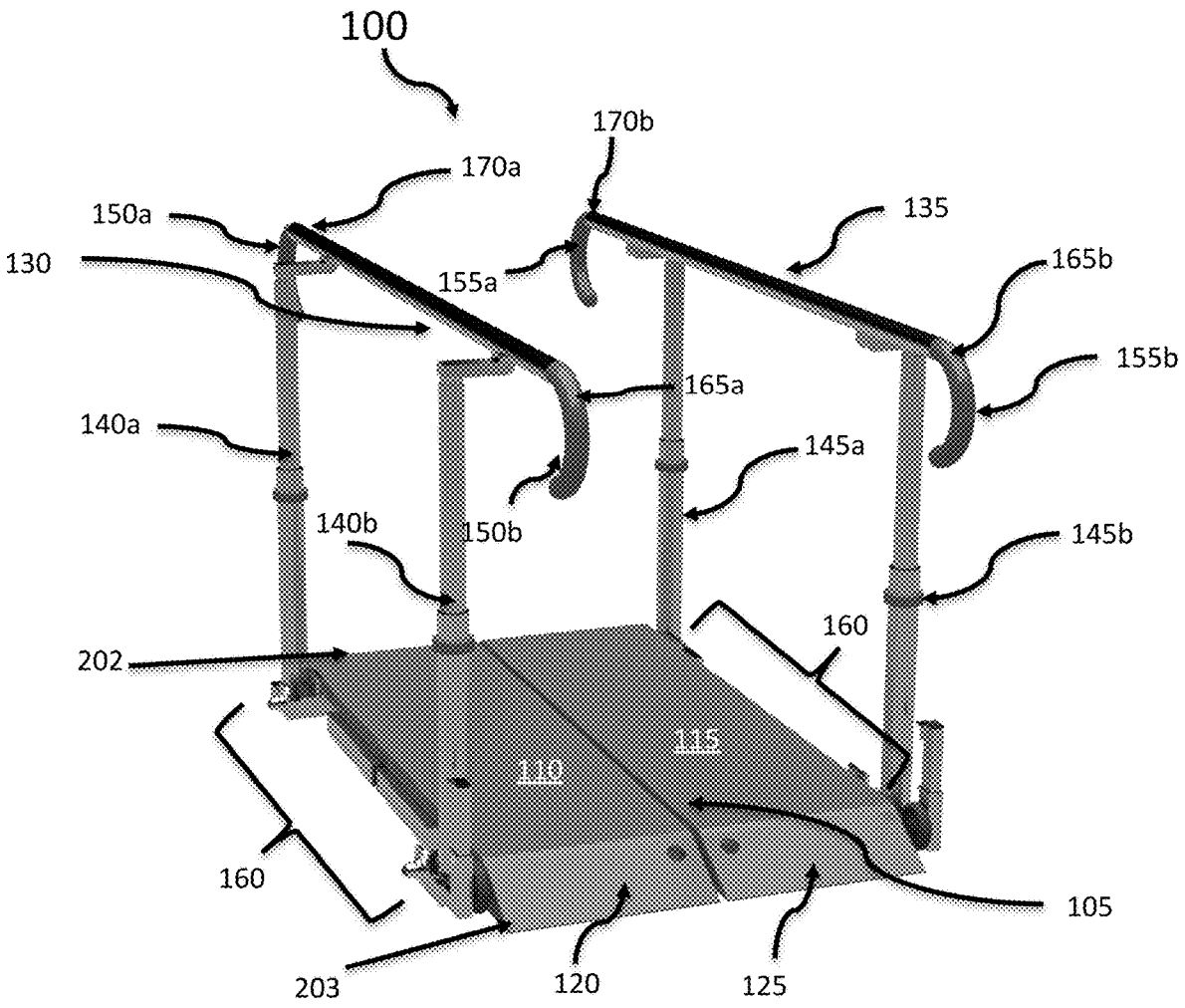
FIG. 1 illustrates a perspective view of one embodiment of a portable physical therapy parallel bar system.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above-mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the contemplated invention(s). Other embodiments may be utilized, and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

The present invention functions to provide a foldable parallel bar device that is easily transportable to and from individuals. In addition, the present invention allows for compact storage while in the folded configuration. The present invention discloses novel portability functions and features to quickly and easily unfold and become immovably secure. In this field of invention, providing a stable, rigid device for a user to pull themselves up to a standing position, walk, and lean on without fear of the device collapsing is crucial. Further, the present invention functions to provide a parallel bar system that is adjustable according to the size (e.g., height, overall width, etc.) of a user. The present invention is used when users may require or desire the assistance of parallel bars or handrails in order to walk, gain strength, and/or improve coordination and balance, but can additionally or alternatively be used for any suitable application. These suitable applications may include other rehabilitative mobility exercises, training physical therapists, or general exercising.

Notably, the present invention is foldable into a portable configuration. More specifically, it will be appreciated that the present invention requires appreciably few, if any, components to be disassembled or removed prior to folding into the portable, or retracted, configuration. Advantageously, components of the present invention remain coupled in some manner to avoid losing or keeping track of disassembled or removed components. The present invention may also include a transport mechanism, for example, wheels, casters, etc. that allow for easy transport or movement while in the folded configuration. For example, the transport mechanism may comprise a wheel, one or more wheels, a set of wheels, or a plurality of wheels (e.g., 1 wheel, 2 wheels, 3 wheels, 4 wheels, etc.). Additionally, and optionally, storage compartments may be integrated into the present invention configured to allow storage of items, such as manuals, instructions, bands, therapy devices, or any other personal items. Integrated band therapy and a step accessory expands the optionality of the device for uses for physical conditioning as well.

While the present invention is easily transportable, the construction design and materials allow a user to easily and quickly erect the present invention for immediate use. The present invention should be stable and rigid enough to allow users of a wide range of sizes and weights to walk across, lean against, and/or pull themselves along or upright. Additionally, it is anticipated that a therapist may also have to walk across the present invention along with the user and/or a user may use a wheelchair on the present invention, thereby adding additional weight requirements. Therefore, specifications for the present invention require the selected materials to be adequately strong and durable, while remaining lightweight for portability and cost effectiveness. The materials used in constructing the present invention may include one or more of: metals, such as a lightweight steel, aluminum, or titanium; non-metallic materials, such as rigid plastics, composite materials, carbon fiber or other fiber-reinforced plastics; flexible materials such as foam mats or inflatable air mats; or a combination thereof.

Further, the present invention is designed for easy adjustability according to a wide range of user sizes. As will be discussed further below, handrails, for example, may be raised or lowered depending upon the height of the user. Additionally, handrails may be adjusted inwardly or outwardly depending on, for example, an arm reach or a girth of the user. In this manner, the present invention may be used for users of a wide range of individual sizes. Further, length extenders may be integrated into the handrails that are configured to extend the overall handrail length allowing for a user in a wheelchair, for example, to approach the present invention in a seated position, hold onto the extenders, and pull themselves upright before walking across a platform of the present invention.

FIG. 1 illustrates one embodiment of the present invention. As shown, the portable device 100 is fully erected and ready for use. A platform 105 is in a downward or use position configured to allow one or more users to stand on and/or walk across. It is further contemplated that the platform 105 is constructed in such a way that it provides a stable surface for additional therapy devices. In a non-limiting example, a user could place a step or riser on the platform 105 surface to aid in additional therapy processes. In the illustrated embodiment, the platform 105 comprises a first base panel 110 and second base panel 115. Alternatively, the platform 105 comprises one panel or a plurality of panels, for example multiple panels that are aligned on the frame similar to leaves of a table. When moving to the folded configuration, each individual panel may be removed or folded up to collapse the frame. Still alternatively, there is no platform coupled to the frame such that the floor is the portion which a person walks or moves.

In some embodiments, the platform 105 may have a ramp feature on a first end 202 or a second end 203. In an embodiment, both the first base panel 110 and the second base panel 115 have a first angled ramp 120 and a second angled ramp 125, respectively. The first angled ramp 120 and the second angled ramp 125 can be on the first end 202, the second end 203 or on both 202, 203 ends of the first base panel 110 and the second base panel 115 to facilitate easy access onto and off the platform 105. Other embodiments may include a platform 105 constructed of, at least in part, a compressible mat material being of a suitable material and thickness to support the users. The mat material may be a foam material, air-fillable material, fibrous material, or any other material known in the art. The platform 105 may be constructed to fold in a series of alternating folds, for example, similar to an accordion, along several lengths and/or widths. In the retracted or folded configuration of the present invention, the platform 105 may remain integrated or may be removed. It will be appreciated that the present invention may also be constructed to utilize the floor as the platform 105, thus removing the need for a dedicated platform 105 component.

As shown in FIG. 1, a first handrail 130 and a second handrail 135 run substantially parallel along the length of the platform 105 and are coupled to a first set of telescoping stanchions 140*a*, 140*b* and a second set of telescoping stanchions 145*a*, 145*b*, respectively, located on each lengthwise edge 160 of the platform 105. In one embodiment, the lengthwise edge 160 of the platform 105 may be about 60 cm (2 ft) to about 183 cm (6 ft); about 121 cm (4 ft) to about 183 cm (6 ft); about 106 cm (3.5 ft) to about 137 cm (4.5 ft); etc. In one embodiments, a width of the platform 105 may be about 30.48 cm (1 ft) to about 183 cm (6 ft); about 60 cm (2 ft) to about 91.44 cm (3 ft); about 45.72 cm (1.5 ft) to about 137 cm (4.5 ft); etc. In one embodiment, the first handrail 130 has a length that is substantially equal to the lengthwise edge 160 of the platform 105, such that the first handrail 130 may be about 60 cm (2 ft) to about 183 cm (6 ft); about 121 cm (4 ft) to about 183 cm (6 ft); about 106 cm (3.5 ft) to about 137 cm (4.5 ft); etc. In other embodiments, the first handrail 130 may be shorter or longer than the lengthwise edge 160 of the platform 105. In one embodiment, the second handrail 135 has a length that is substantially equal to the lengthwise edge 160 of the platform 105, such that the second handrail 135 may be about 60 cm (2 ft) to about 183 cm (6 ft); about 121 cm (4 ft) to about 183 cm (6 ft); about 106 cm (3.5 ft) to about 137 cm (4.5 ft); etc. In other embodiments, the second handrail 135 may be shorter or longer than the lengthwise edge 160 of the platform 105. It will be appreciated, however, that the platform 105 may be configured into any length, such as about 91 cm (3 ft) to about 153 cm (5 ft).

A first set of handles 150*a*, 155*a* may be coupled to one or both second ends 170*a*, 170*b*, of the first handrail 130 and second handrail 135, respectively, and/or handles 150*b*, 155*b* may be coupled to one or both first ends 165*a*, 165*b* of the first handrail 130 and second handrail, respectively. The first set of handles 150*a*, 150*b* and the second set of handles 155*a*, 155*b* allow for easy grabbing and assisting users as they move onto the platform 105. One or more of the first set of handles 150*a*, 150*b* and/or the second set of handles 155*a*, 155*b* may adjustably extend outward from the first handrail 130 and second handrail 135, respectively. The first set of handles 150*a*, 150*b* and the second set of handles 155*a*, 155*b* may be removably or irreversibly coupled to the device 100, such that the first set of handles 150*a*, 150*b* and the second set of handles 155*a*, 155*b* may be a component (e.g., cylindrical, square, rectangular, etc.) that is concentrically inserted into or over the first handrail 130 and second handrail 135, respectively. For example, the first handle may comprise a male connector that is movably inserted into a female connector of a first handrail or the first handrail may comprise a male connector that is movably inserted into a female connector of the first handle. In some embodiments, the first set of handles 150 *a*, 150*b* and the second set of handles 155*a*, 155*b* may be curved, arcuate, T-shaped, or the like to assist the user in increasing grip on the device, especially during the critical step of pulling oneself onto the device. Additionally, the handrails 130, 135 can be one piece with ends bent into the desired handle so that it is one continuous piece. This reduces number of components, drives down production costs, improves structural durability and reduces potential failure of device.

The first handrail 130, second handrail 135, the first set of handles 150*a*, 150*b*, and/or the second set of handles 155*a*, 155*b* may each (or a subset of them) define holes that are configured to receive locking pins for setting a desired extension length or height. The first set of handles 150*a*, 150*b* and the second set of handles 155*a*, 155*b* may telescope outward and retract inward, respectively, to the first handrail 130 and second handrail 135. Alternatively, or additionally, the first set of handles 150*a*, 150*b* and the second set of handles 155*a*, 155*b* may be of a suitable length and have a suitable tension that they can be extended without a physical locking mechanism. It will be appreciated that the extended distance of the first set of handles 150*a*, 150*b* and the second set of handles 155*a*, 155*b* may be selected based on the user's desire and/or needs. For example, a user in a wheelchair may approach the platform 105, grab onto one of the extended first set of handles 150*a*, 150*b* and one of the extended second set of handles 155*a*, 155*b*, and pull themselves upright from their seated position without the wheelchair having to get onto the platform 105 and/or without requiring the user to lean too far forward to reach an unextended first set of handles 150*a*, 150*b* and/or second set of handles 155*a*, 155*b*. In some examples, the first set of handles 150*a*, 150*b* and the second set of handles 155*a*, 155*b* may be extended from a handrail by about 30 cm (1 ft); about 16 cm (0.5 ft) to about 46 cm (1.5 ft); about 7 cm (0.25 ft) to about 39 cm (1.25 ft); about 30 cm (1 ft) to about 92 cm (3 ft); etc. depending on the user's physical range of motion or comfort level.

Figure 2:
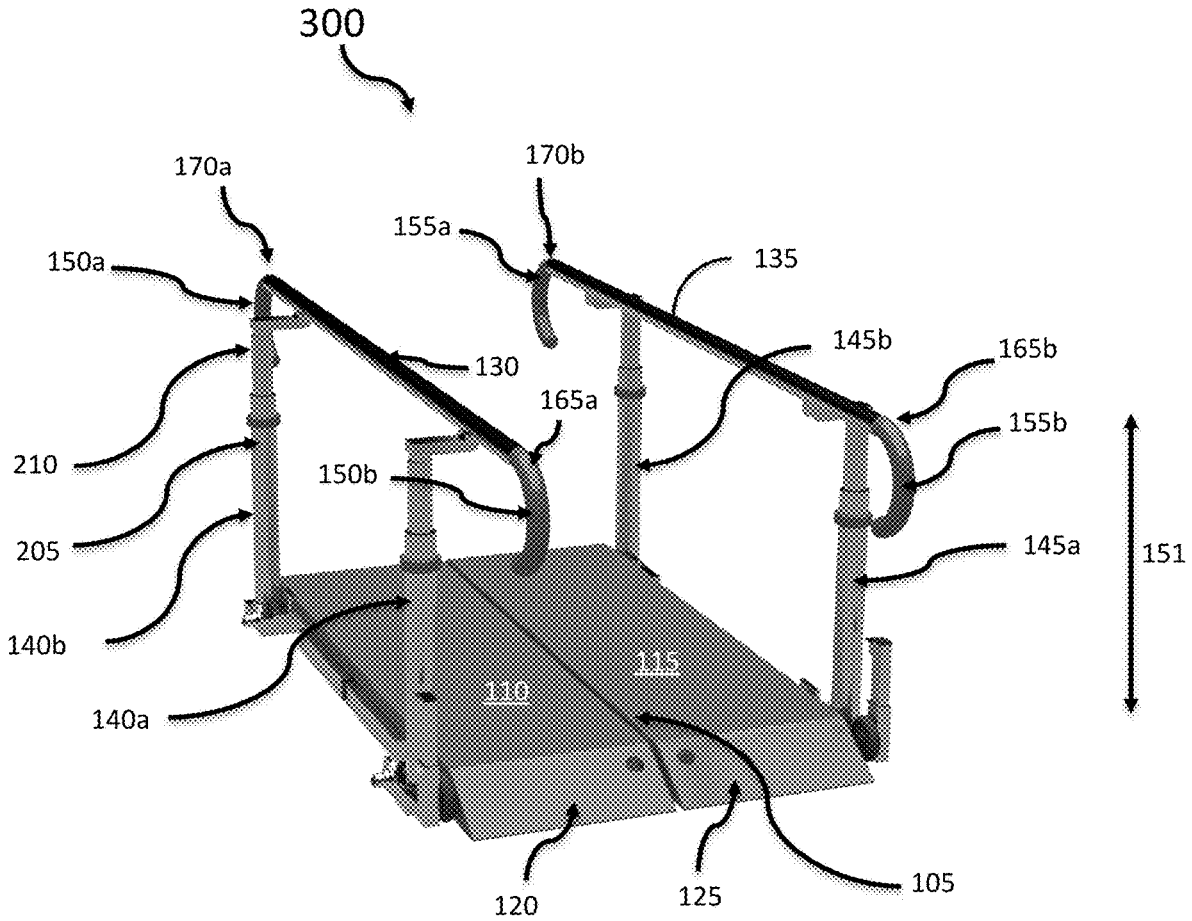
FIG. 2 illustrates a perspective view of the embodiment of FIG. 1 with the handrails at a second or mid-height.
Figure 3:
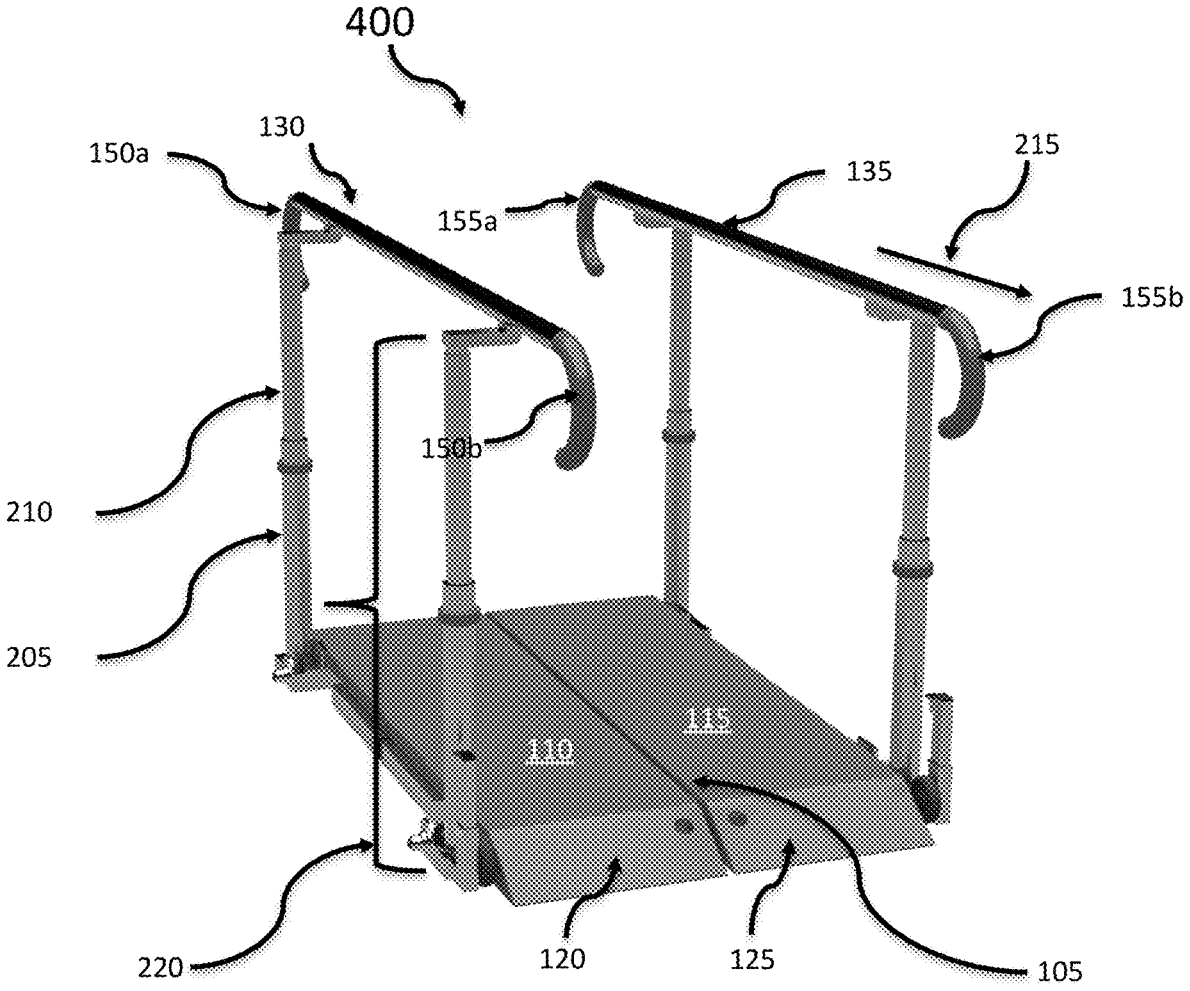
FIG. 3 illustrates a perspective view of the embodiment of FIG. 1 with the handrails at a first height.

FIGS. 2 and 3 illustrate one embodiment of height-adjustable first handrail 130 and second handrail 135 of the present invention. Although two handrails are depicted, it will be appreciated that, at least in some embodiments, only one handrail may be present. The first handrail 130 and/or the second handrail 135 are configured to adjust to a height that is suitable for the user to hold while using the system or ambulating across the platform 105, for example, from about 71 cm (28 in) to about 102 cm (40 in); about 63 cm (25 in) to about 127 cm (50 in); about 38 cm (15 in) to about 115 cm (45 in); about 50 cm 20 in to about 102 cm (40 in); etc. in height 220, as shown in FIG. 3. Various methods and/or mechanisms are envisioned for adjusting and locking the first handrail 130 and/or the second handrail 135 to a desired height. For example, in one embodiment, each of the first set of telescoping stanchions 140*a*, 140*b* and/or a second set of telescoping stanchions 145*a*, 145*b* may be configured with an external stationary member 205 and an internal height-adjustable member 210. Each of the external stationary members 205 and internal height-adjustable members 210 may define one or more apertures that, when aligned (i.e., a hole of the exterior stationary member may be aligned with a hole of the interior stationary member), may be concentrically mated, resulting in a corresponding height. Markings or numbers may also be present on the external stationary members 205 and/or internal height-adjustable members 210 signifying the various heights for easy reference. In this manner, the first handrail 130 and the second handrail 135 may be configured to be adjusted up or down, corresponding to the directions of arrow 151, to a desired height position. A lock and release mechanism, such as, for example, a pin (not shown), may be integrated with or attached to the external stationary member 205 of each of the first set of telescoping stanchions 140*a*, 140*b* and the second set of telescoping stanchions 145*a*, 145*b*. For example, the pin may be attached to the first set of telescoping stanchions 140*a*, 140*b* and the second set of telescoping stanchions 145*a*, 145*b* with a cord or plastic tab and inserted into one of the number of holes corresponding to the desired height position, thereby locking each stanchion and thus a respective handrail 130, 135 in a desired position. Another embodiment may include pneumatic members, air members, hydraulic members, electric linear actuators, or any other actuation components known in the art, integrated into the first set of telescoping stanchions 140*a*, 140*b* and the second set of telescoping stanchions 145*a*, 145*b* that are configured to extend, lock, and retract the coupled first handrail 130 and second handrail 135 to the desired height. The pins are designated with a color or some marking to easily identify if stanchions are in locked and unlocked position as a safety feature. In some embodiments, the pins may comprise a colored portion of the active shaft. In this way, the colored portion is only visible when the pin is locked or unlocked to easily signify the pins position.

FIG. 2 illustrates the first handrail 130 and the second handrail 135 adjusted to a first lowered position 300, and FIG. 3 illustrates the first handrail 130 and the second handrail 135 adjusted to a second raised position 400 with the internal height-adjustable member 210 of the first set of telescoping stanchions 140*a*, 140*b* and the second set of telescoping stanchions 145*a*, 145*b* further extended. It will be appreciated that the first handrail 130 and the second handrail 135 may be independently adjusted and may be positioned to varying heights. For example, the first handrail 130 may be positioned higher than the second handrail 135. Additionally, or alternatively, a first end 165*a* of the first handrail 130 may be positioned higher than the second end

170*a* of the first handrail 130 or vice versa. Likewise, a first end 165*b* of the first handrail 135 may be positioned higher than the second end 170*b* of the first handrail 135 or vice versa. In such an embodiment, the width extenders 405*a*, 405*b*, 405*c*, 405*d* may utilize rotation mechanisms known in the art coupled to at least a portion to each width extender 405*a*, 405*b*, 405*c*, 405*d*.

Figure 4:
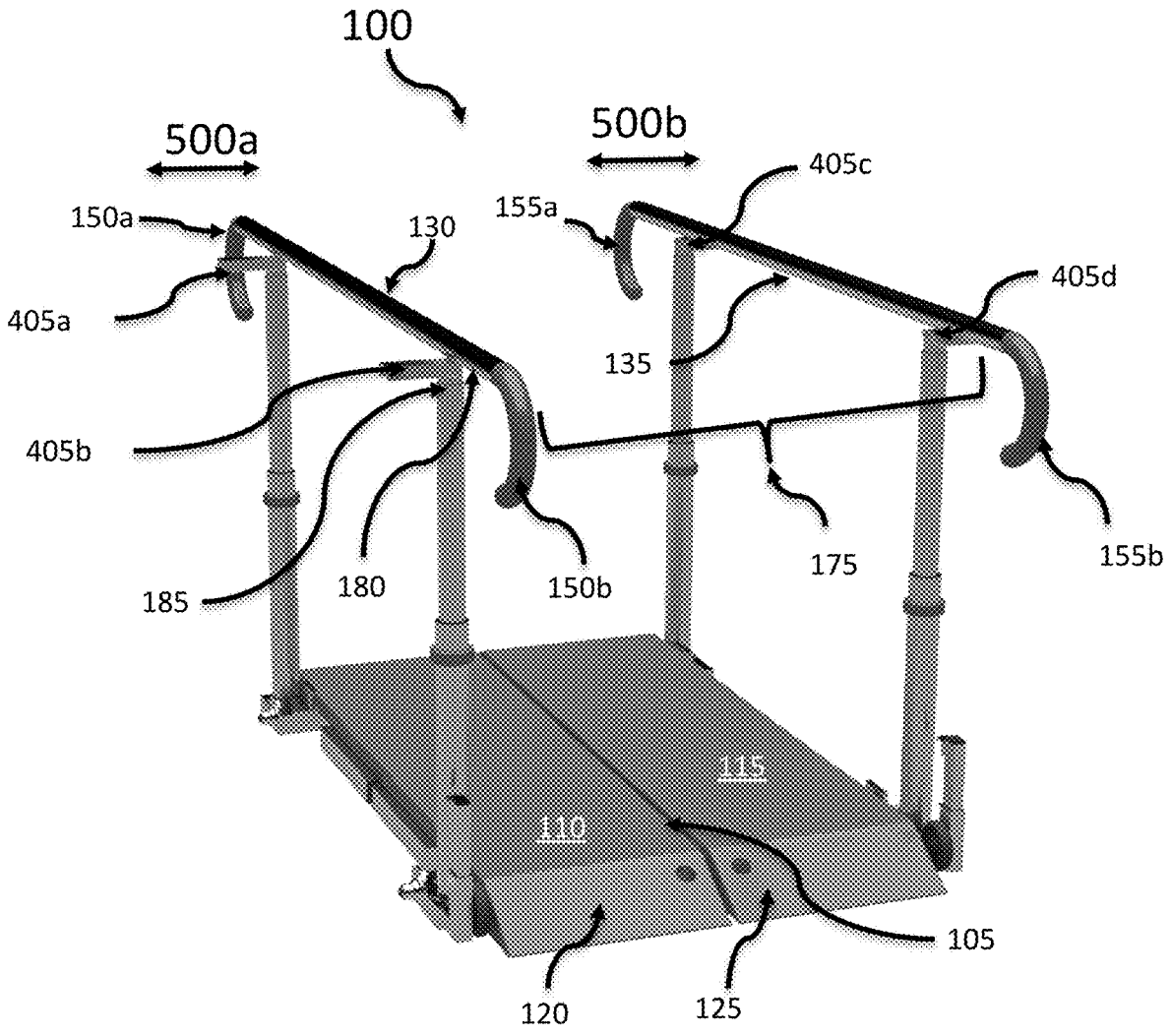
FIG. 4 illustrates a perspective view of the embodiment of FIG. 1 with the handrails in a first position.

FIG. 4 illustrates one embodiment of the width-adjustability of the first handrail 130 and the second handrail 135 of the present invention. As will be appreciated, either one or both handrails 130, 135 may be width-adjusted. As shown, the first handrail 130 and the second handrail 135 are configured to adjust such that a width 175 between the first and second handrails 130, 135 is suitable for the user. For example, the first handrail 130 and/or the second handrail 135 may adjust toward or away from one another from about 71 cm (28 in) to about 92 cm (36 in); about 63 cm (25 in) to about 102 cm (40 in); about 50 cm (20 in) to about 127 cm (50 in); etc. in width 175. Width extenders 405*a*, 405*b*, 405*c*, 405*d* are operatively coupled to each of a top portion 185 of the internal height-adjustable member 210 and coupled to a bottom portion 180 of the first handrail 130 and the second handrail 135. In this manner, various width adjustments may be made by sliding the first handrail 130 and/or second handrail 135 along or relative to each of the width extenders 405*a*, 405*b*, 405*c*, 405*d* in either direction, shown by arrows 500*a*, 500*b*, perpendicular to the first handrail 130 and the second handrail 135, and in the horizontal plane. Optionally, each width extender 405*a*, 405*b*, 405*c*, 405*d* may also or alternatively slide relative to each internal height-adjustable member 210 to reach the desired width 175. In one embodiment illustrated in FIG. 5, the width extenders 405*a*, 405*b*, 405*c*, 405*d* are about 5 cm (2 in) to about 16 cm (6 in) in length 190, however, it is envisioned that the width extenders may be shorter or longer depending on the design.

Figure 5:
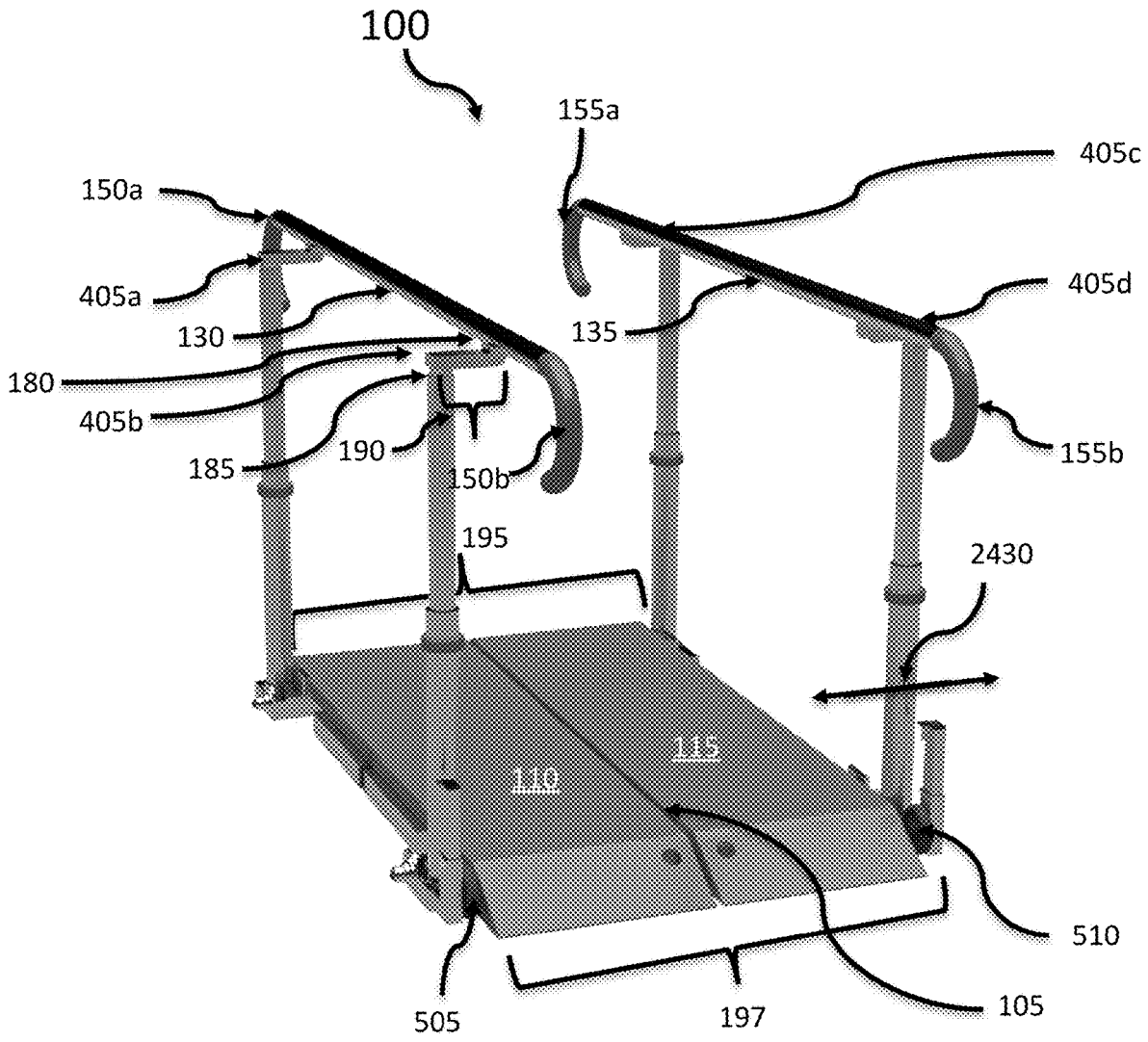
FIG. 5 illustrates a perspective view of the embodiment of FIG. 1 with the handrails in a second position.
Figures 24A, 24B:
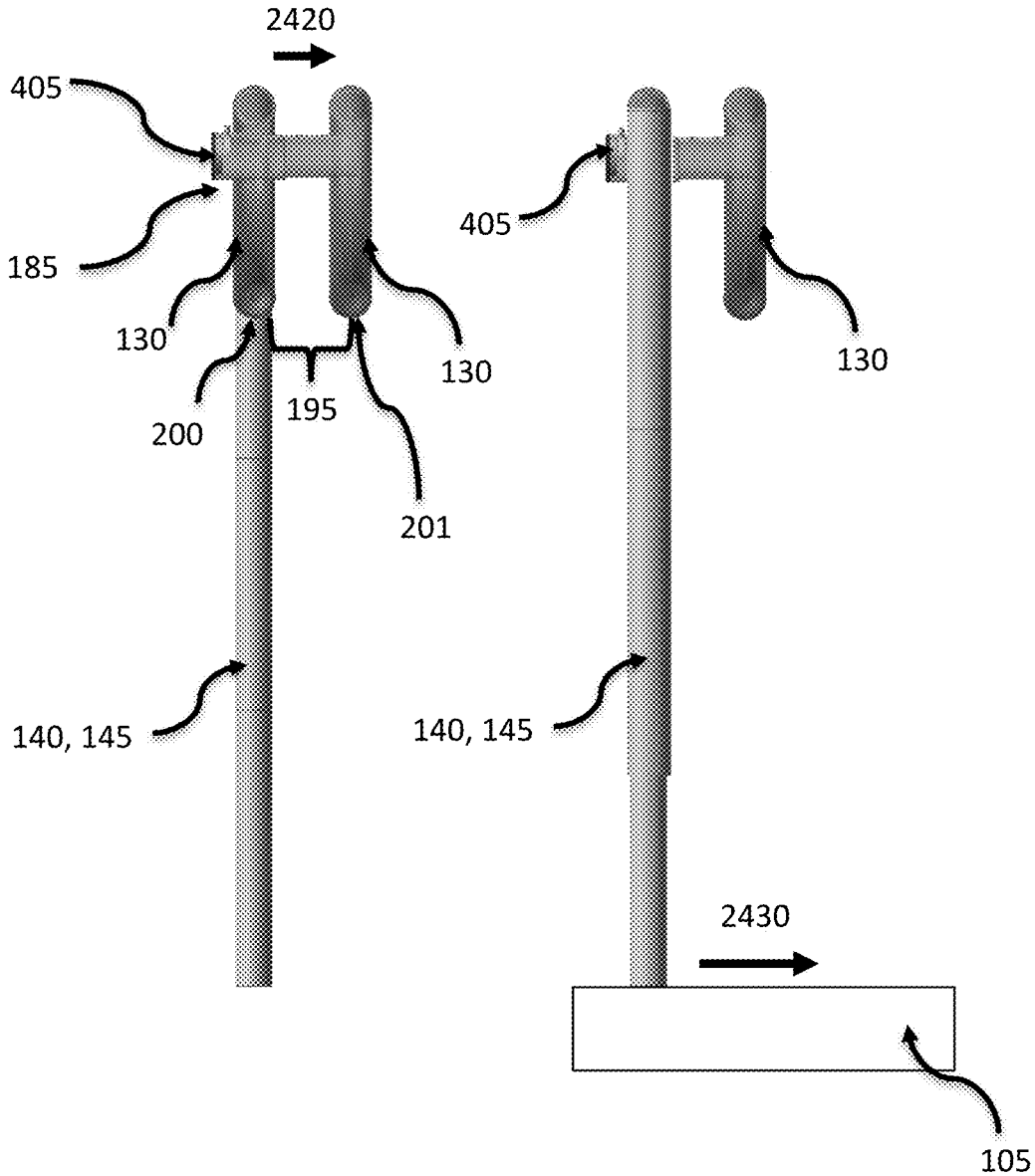
FIGS. 24A-24E illustrate various embodiments for adjusting a width of one or more handrails.
Figure 24C:
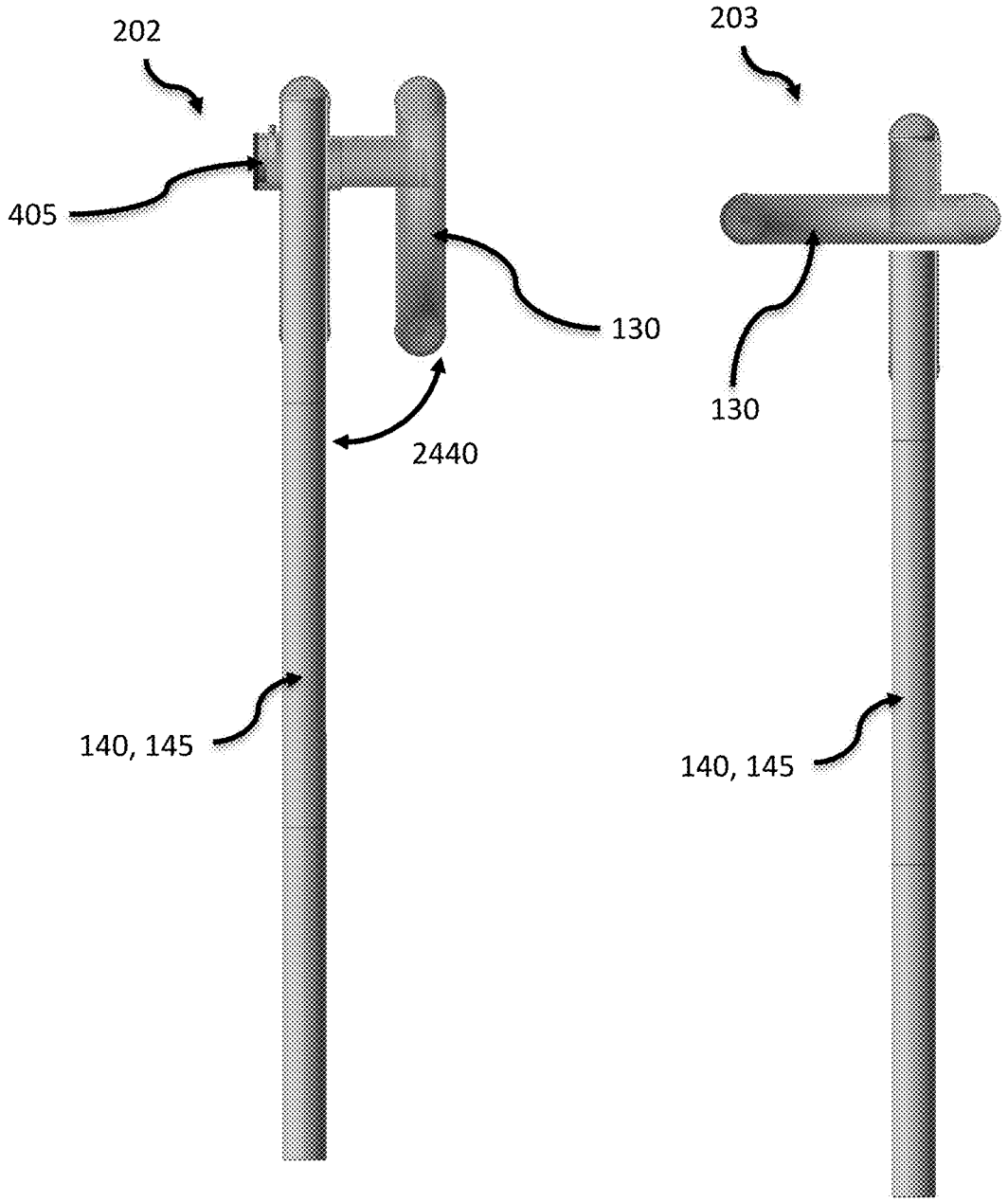
Figure 24D:
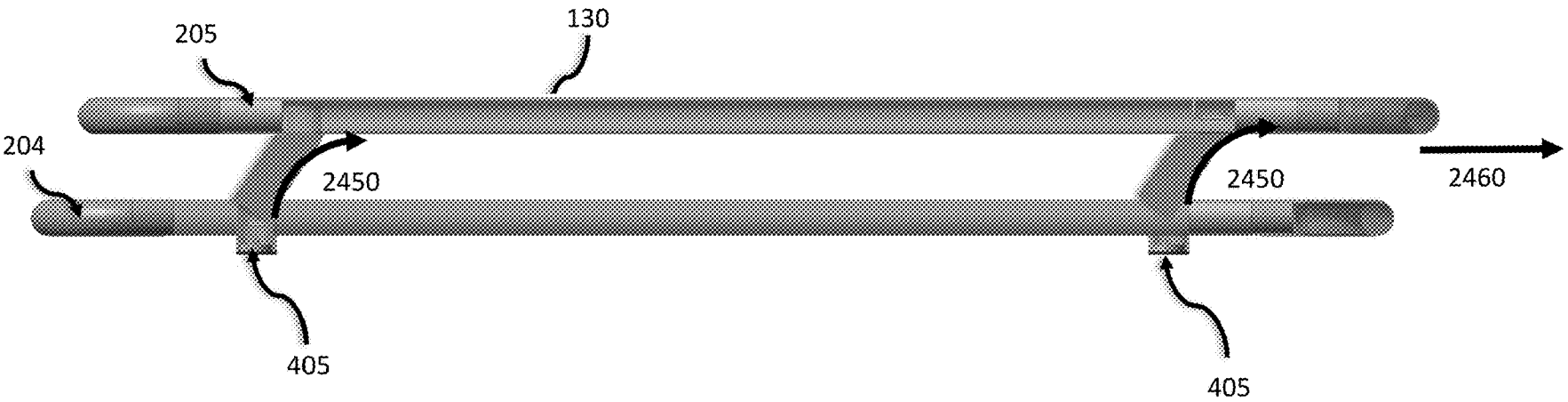
Figure 24E:
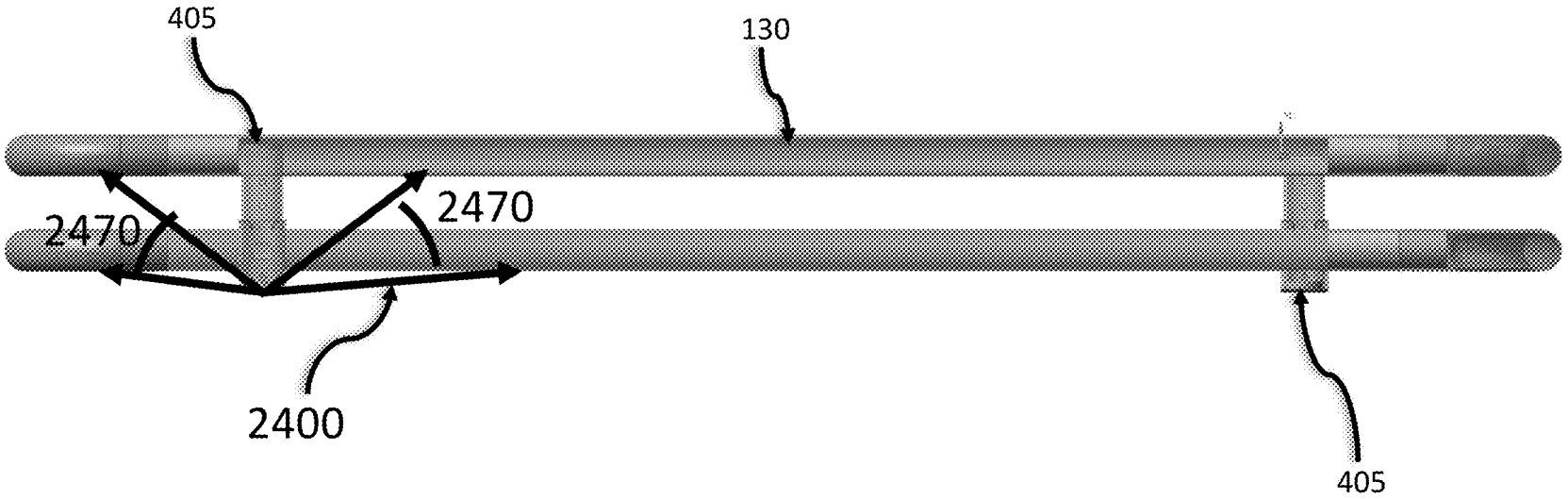

FIGS. 24A-24F show various embodiments for adjusting a handrail width 195 of the first handrail 130 or the second handrail 135, relative to a respective stanchion, or adjusting a width 175 between the first handrail 130 and the second handrail 135. FIGS. 24A-24F show a prior position 200 of handrail 130 and an adjusted position 201 of handrail 130 for illustrative purpose. For example, as shown in FIG. 24A and described elsewhere herein, the first handrail 130 and/or the second handrail 135 may slide substantially horizontally, shown by arrow 2420, at the top portion 185 of both the first set of telescoping stanchions 140*a*, 140*b* and the second set of telescoping stanchions 145*a*, 145*b* along the corresponding width extenders 405*a*, 405*b*, 405*c*, 405*d*. In another embodiment, as shown in FIG. 24B, the first set of telescoping stanchions 140*a*, 140*b* and/or the second set of telescoping stanchions 145*a*, 145*b* may slide in and out substantially horizontally, shown by arrow 2430, with respect to the platform 105 or the first lengthwise bar 1210 to adjust a width 175 between the first handrail 130 and the second handrail 135, as also shown in FIG. 5. In a further embodiment, as shown in FIG. 24C, the first handrail 130 and/or the second handrail 135 tilts in or out along a path shown by arrow 2440, between a first position 202 and a second adjusted position 203, to adjust a width between the handrails. In such embodiments, each of the first set of telescoping stanchions 140*a*, 140*b*, the second set of telescoping stanchions 145*a*, 145*b*, and/or one or more width extenders may include a mechanism such as a hinge or another analogous device known in the art to accommodate the tilting. In a still further embodiment, as shown in FIG. 24D, each width extender 405 may rotate along a path shown by arrows 2450 to pivot the first handrail 130 and/or the second handrail 135 substantially horizontally (shown by arrow 2460) relative to the stanchions between a first position 204 and a second position 205. As such, the first handrail 130 and/or the second handrail are configured to travel horizontally 2460 during adjustment. In another embodiment, as shown in FIG. 24E, one or more scissoring mechanisms 2400 are used in place of the width extenders 405, such that angle 2470 increases or decreases, respectively, to decrease or increase the width between the first handrail 130 and the second handrail 135. The scissoring mechanism 2400 may be applied to the first handrail 130 and/or the second handrail 135.

Figure 6:
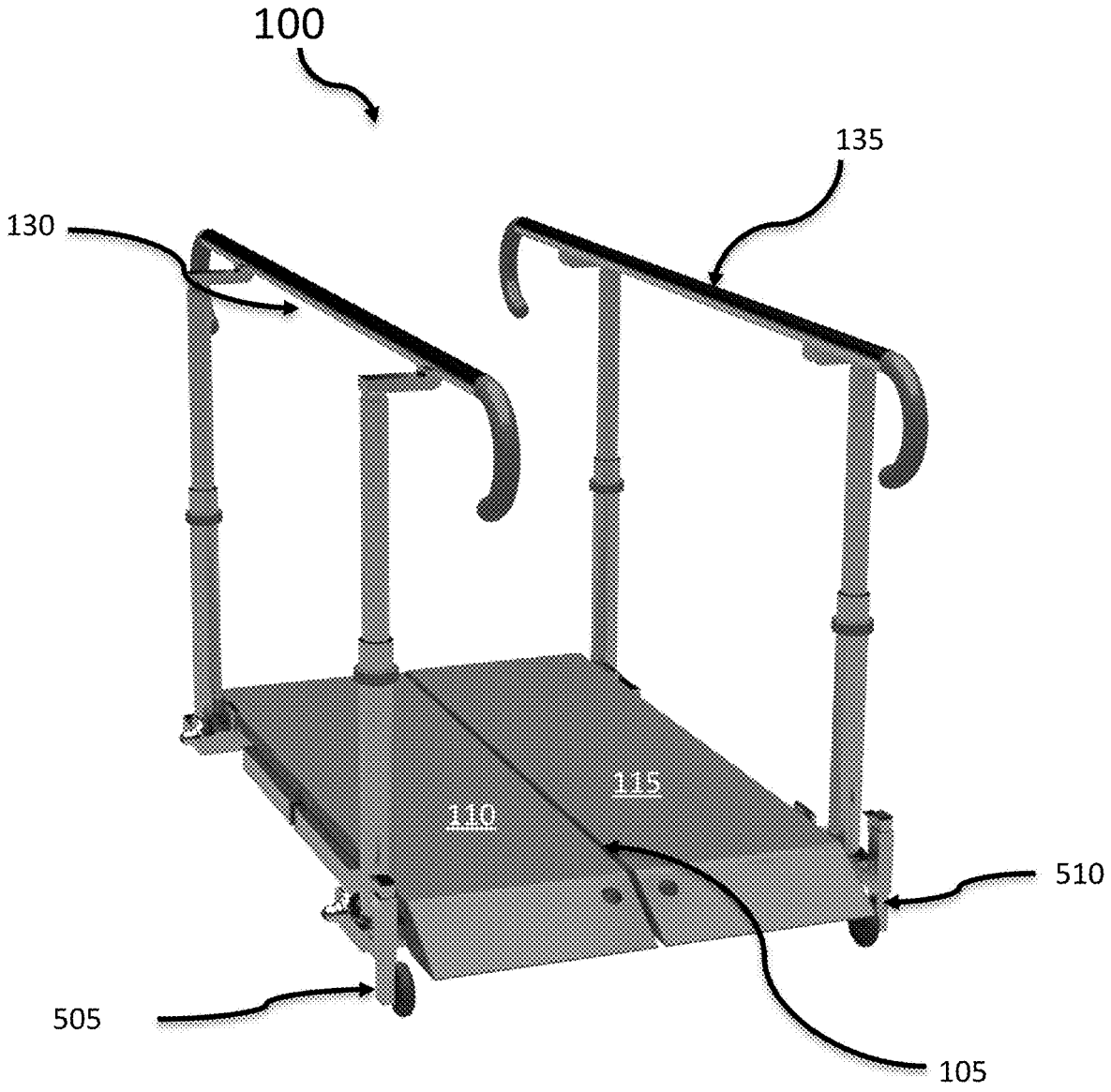
FIG. 6 illustrates a perspective view of the embodiment of FIG. 1 with a transport mechanism extended.
Figure 13:
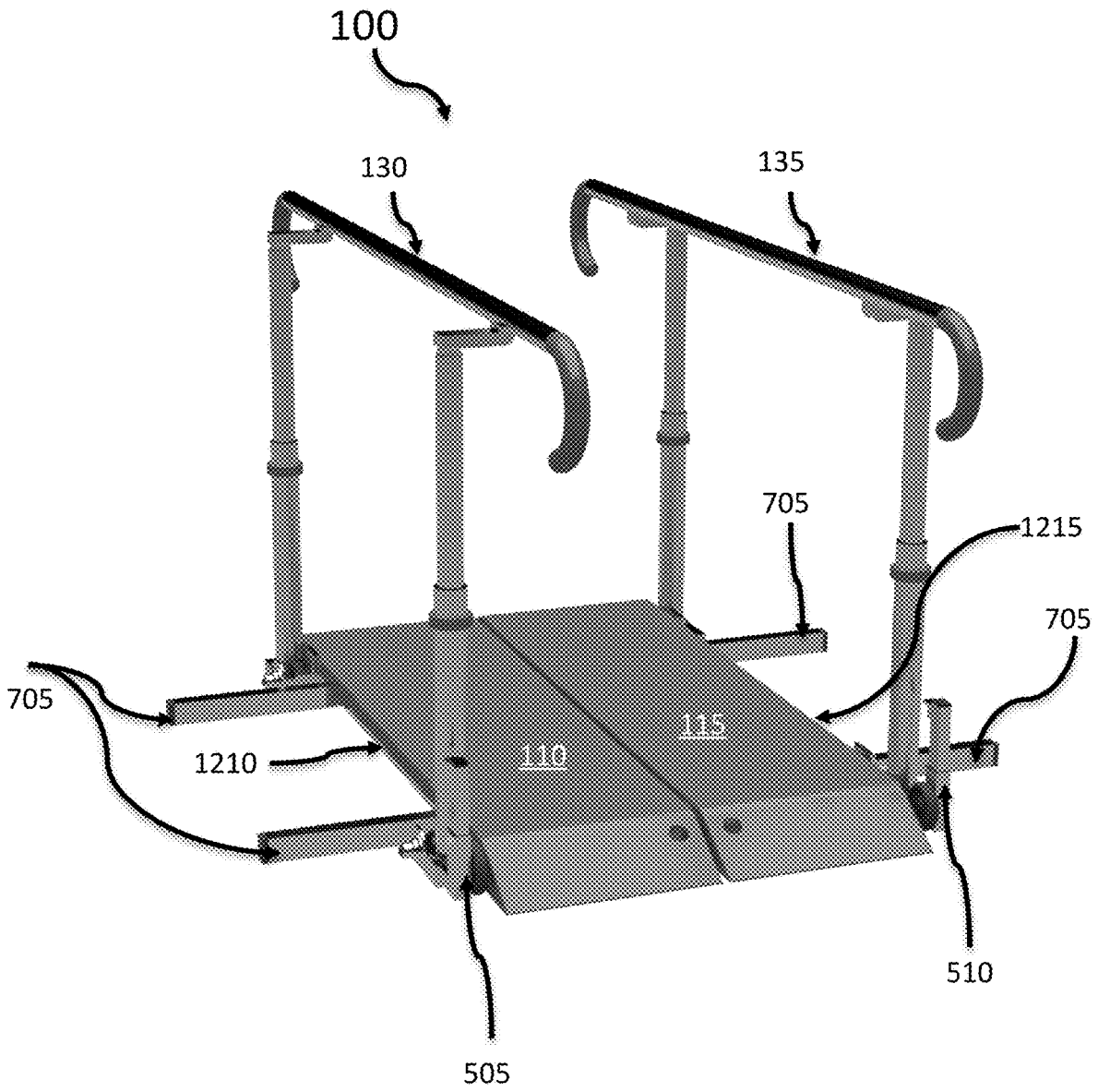
FIG. 13 illustrates a perspective view of the embodiment of FIG. 1.

Returning to FIGS. 5-6, which illustrate one embodiment of the present invention including a first wheel 505 and second wheel 510, one or both being extendable, for movement and portability. As shown in this example, transport mechanism comprises a first wheel 505 and second wheel 510, which may be positioned on a first end 197 or on a second end 195 of the device 100. Additionally, and with duplicates of the first wheel 505 and the second wheel 510, the first wheel 505 and the second wheel 510 can be placed on both the first end 197 and the second end 195. As shown in FIG. 5, when the device 100 is erected and in-use, the first wheel 505 and the second wheel 510 are configured to be retracted vertically to a point that the wheel no longer crosses the lowest surface plane of the frame. In other words, the first wheel 505 and the second wheel 510, in a retracted state, can no longer make contact with the ground or a surface beneath the frame 1205. The first wheel 505 and/or second wheel 510 may be retracted into a cavity between a stanchion and base panel or a cavity between a stanchion and frame when the device is in an unfolded configuration. The first wheel 505 and the second wheel 510 may be coupled to the first telescoping stanchion 140*a* and the second telescoping stanchion 145*a*. Alternatively, the transport mechanism may each be coupled to an outer edge of a frame (as shown in FIG. 13) of the device 100. As shown in FIG. 6, first wheel 505 and the second wheel 510 may be extended when the device is in a folded configuration to engage a surface that then allows a user to lift an opposite end of the device 100 and easily change positions or transport the portable device along a surface using the wheels.

Figure 7:
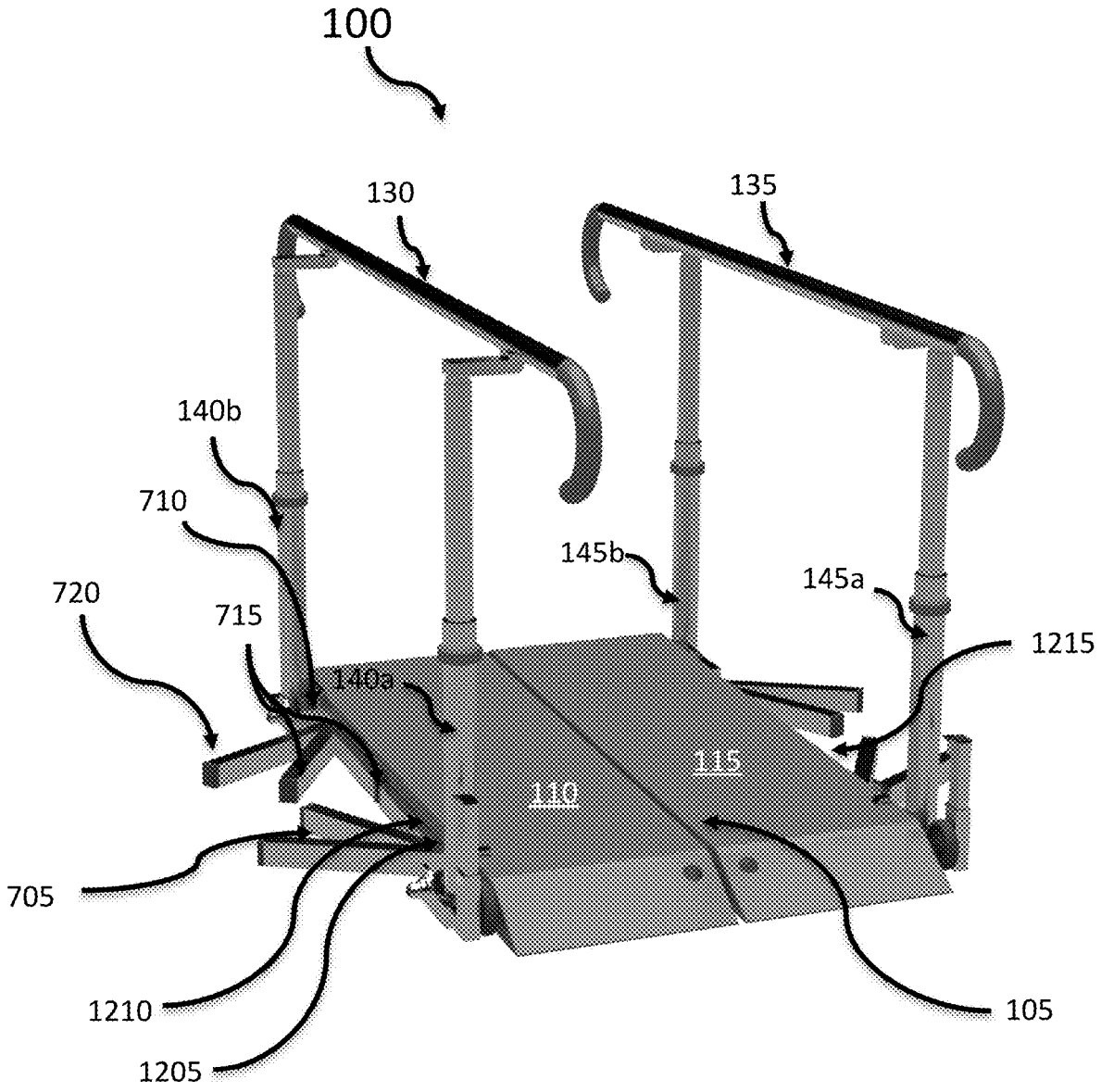
FIG. 7 illustrates a perspective view of the embodiment of FIG. 1 with one or more supports extended to a partially extended position.
Figure 8:
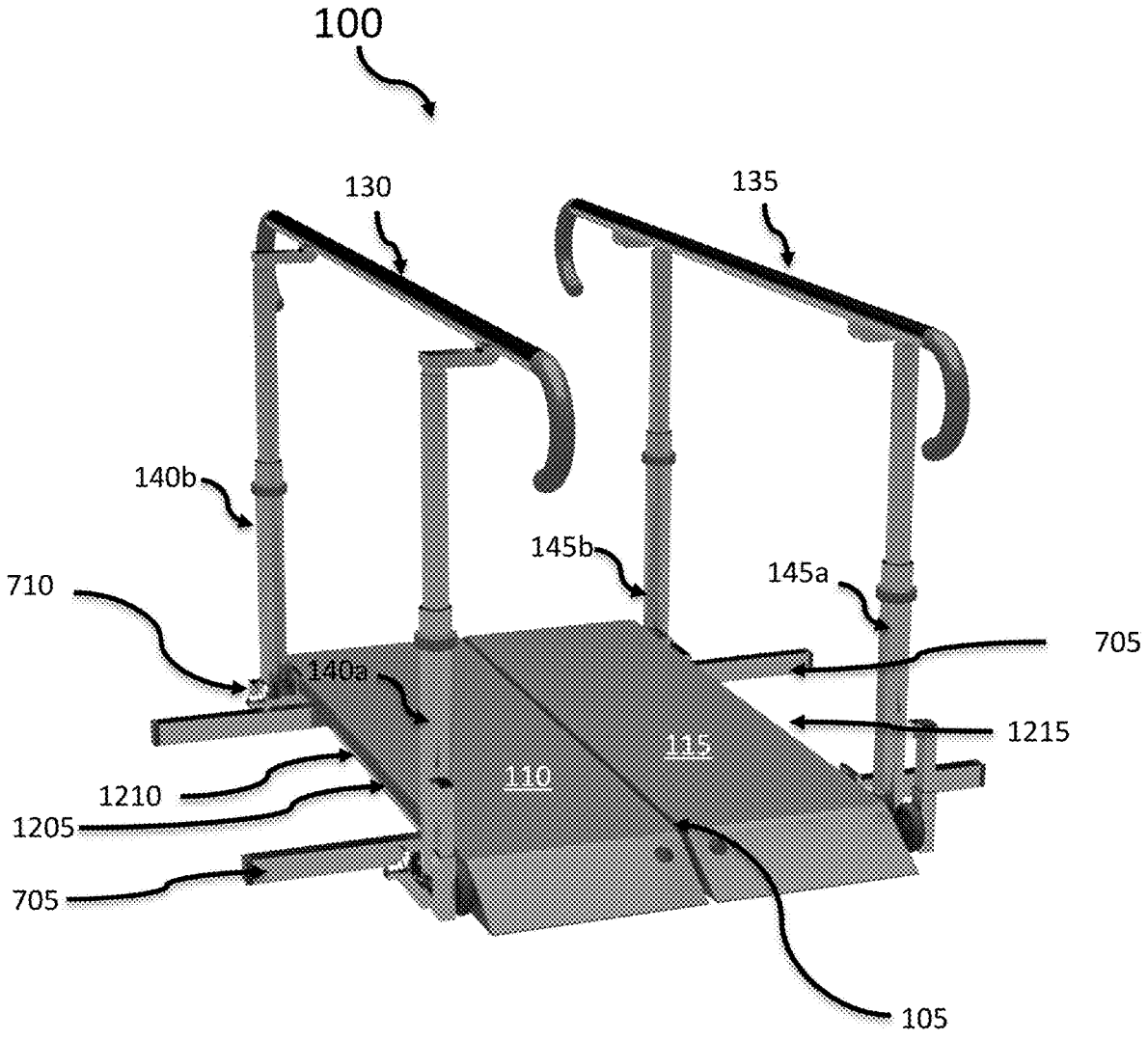
FIG. 8 illustrates a perspective view of the embodiment of FIG. 1 with one or more supports extended to a fully extended position.

FIG. 7 illustrates one embodiment of the present invention including stability supports 705. As shown, one or more or a plurality of stability supports 705, or outriggers, may be coupled to one or both of the first lengthwise bar 1210 and the second lengthwise bar 1215 of the device 100. In one non-limiting example, one or more of the stability supports 705 rotate on, for example, a hinge or folding bracket 710 outwardly (away from the frame) to a substantially perpendicular position for an in-use position and inwardly, for an in-stow position (toward the frame), to a substantially parallel position with respect to the first lengthwise bar 1210 and second lengthwise bar 1215. The stability supports 705 may be fully extended to a substantially perpendicular position, or any angle therebetween, based on the desired degree of additional stability. The stability supports 705 in this example may comprise nesting metal and/or non-metallic bars that rotate on the hinge 710 and can be separated into a fan shape for greater stability of the device 100. When the stability supports 705 are rotated inward, the inner supports 715 nest into the outermost support 720 that then abut to the outer edge of the frame 1205. In one embodiment, magnets are positioned on the first lengthwise bar 1210 or the first base panel 110, and at least a portion of the stability supports 705 is made of a ferromagnetic metal. In this embodiment, the magnet is then capable of holding the stability supports 705 in place when folded inwardly. The placement of these magnets can be on both sides and can include placement on both lengthwise bars 1210, 1215 or both base panels 110, 115, respective to the placement of one or a plurality stability supports 705. Further contemplation includes a non-limiting example in which the folding bracket 710 performs in the vertical plane and not in the horizontal as previously described. Described further, the stability support 705 can then be folded from an in-stow position, which is substantially parallel to the stanchions 140*a*, 140*b*, 140*c*, 140*d*, to an in-use position, which is substantially perpendicular to both the stanchions 140*a*, 140*b*, 140*c*, 140*d* and the lengthwise bars 1210, 1215. In this further contemplation, each stability support 705 is proximal to a respective stanchion 140*a*, 140*b*, 140*c*, 140*d* and a magnet, pin, or other locking device known in the art, attached to the respective stanchion 140*a*, 140*b*, 140*c*, 140*d*, may be used to secure the stability support in the in-stow position. In the opposite, in-use, position, the stability support 705 may be locked in the horizontal plane by means of a pin or other locking device known in the art. FIG. 8 illustrates another embodiment of the portable parallel bar device including stability supports 705. As shown, a fully-extended stability supports 705 may be coupled to the first lengthwise bar 1210 and/or the second lengthwise bar 1215 of the frame 1205 of the device 100. In another non-limiting example, one or more of the four stability supports 705 each rotate on, for example, a hinge or folding bracket 710 outwardly and inwardly anywhere from substantially parallel to substantially perpendicular to the first lengthwise bar 1210 and second lengthwise bar 1215. In another non-limiting example, one or more of the four stability bars 705 may slide a predefined distance out from underneath the platform 105 on the frame 1205 and slide back under the platform 105 when they are not needed or if space prohibits their extension. Alternatively, the stability bars 705 may slide into a similarly shaped lumen, with respect to the cross-section of the stability bar 705, formed in the first lengthwise bar 1210 and/or the second lengthwise bar 1215.

Figure 9:
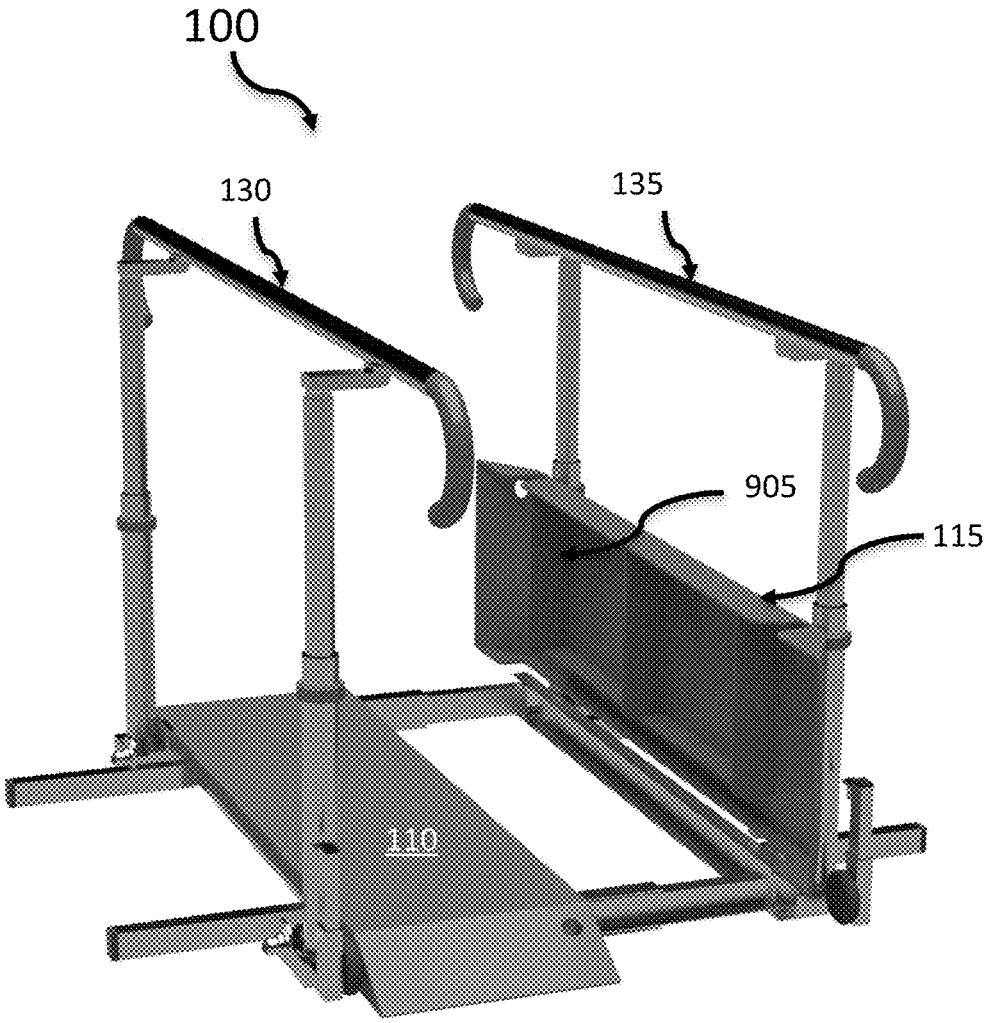
FIG. 9 illustrates a perspective view of the embodiment of FIG. 1 with one or more storage areas visible.
Figure 10:
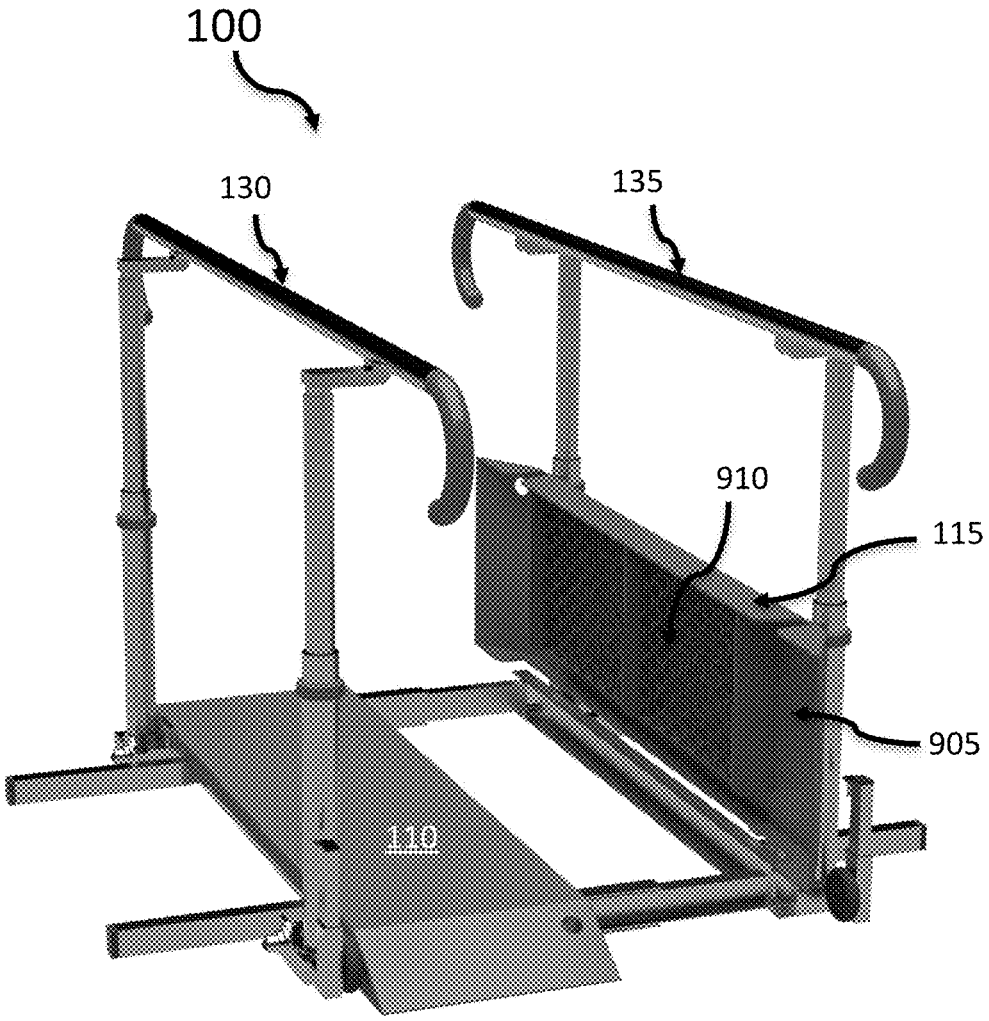
FIG. 10 illustrates a perspective view of the embodiment of FIG. 1 with one or more storage areas visible.
Figure 11:
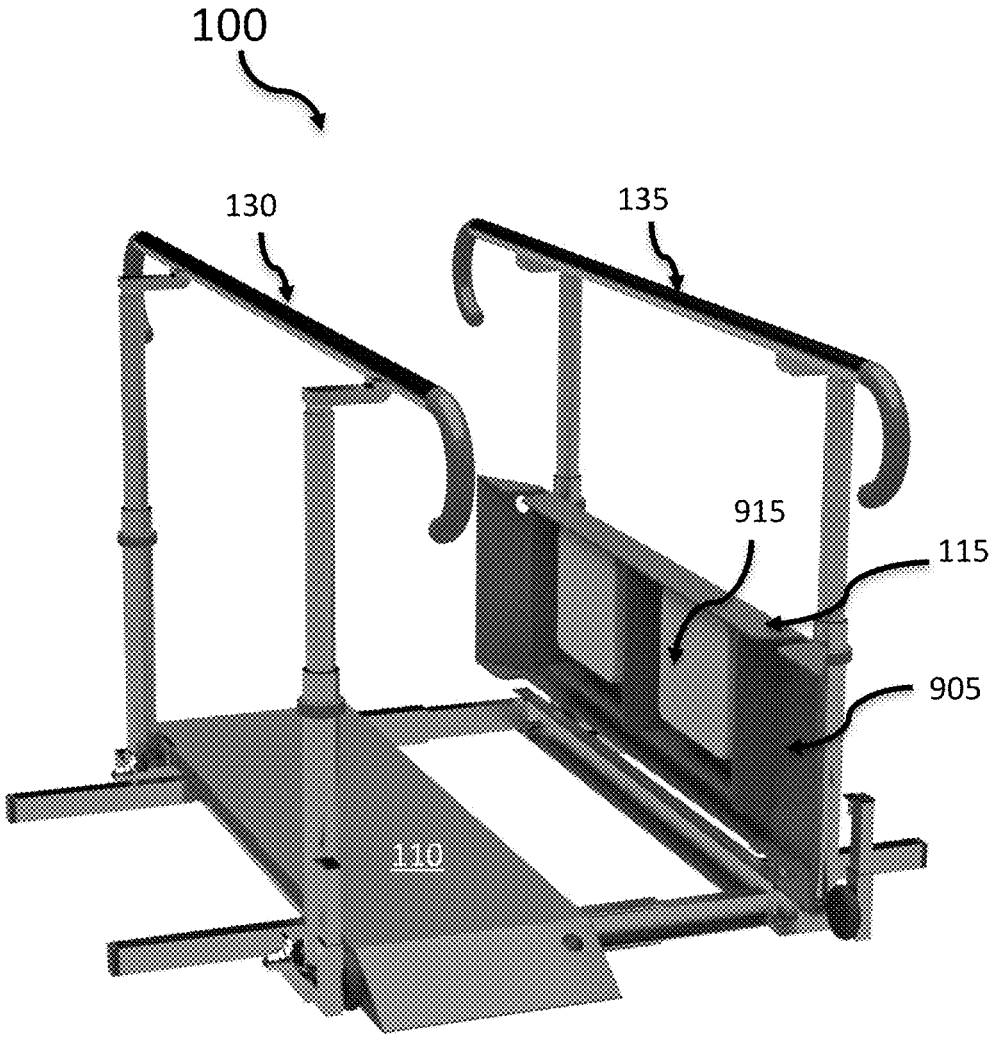
FIG. 11 illustrates a perspective view of the embodiment of FIG. 1 with one or more storage areas visible.

FIGS. 9-11 illustrate embodiments of the portable parallel bar device including storage areas. As shown, a recessed area 905, defined by the first base panel 110 and/or the second base panel 115, may include an open area configured to mount cargo netting 910 (as seen in FIG. 10), pockets, boxes 915 (as seen in FIG. 11), or other types of storage materials. Advantageously, a user may securely store items such as manuals, instructions, therapy bands, or other personal items.

Figure 12:
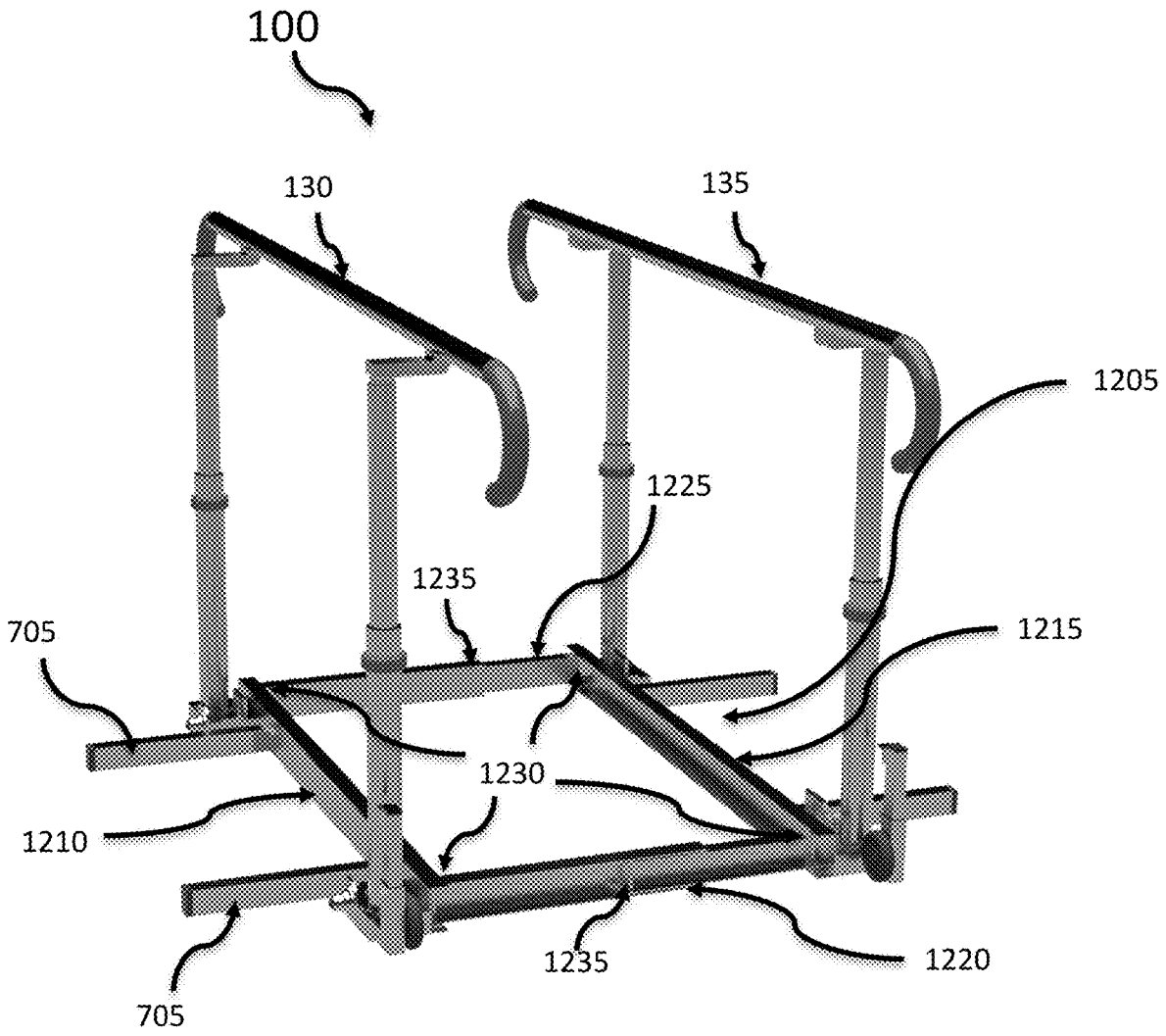
FIG. 12 illustrates a perspective view of one embodiment of a frame of the portable physical therapy system of FIG. 1.

FIG. 12 illustrates one embodiment of a frame 1205 of the present invention. In one embodiment, the frame 1205 is a monolithic component that does not require disassembling prior to folding; in other embodiments, the frame comprises one or more components that may require assembling or dismantling, at least in part, when erecting or collapsing, respectively. As shown, stability bars 705 are extended and coupled to the outer edges of the first lengthwise bar 1210 and the second lengthwise bar 1215 of the frame 1205. The first lengthwise bar 1210 and the second lengthwise bar 1215 are also configured to couple with at least one of the first base panel 110 and the second base panel 115. The frame 1205 also includes a front transverse bar 1220 and a rear transverse bar 1225, perpendicular to the first lengthwise bar 1210 and the second lengthwise bar 1215, for supporting the first base panel 110 and the second base panel 115 of the platform 105. The front transverse bar 1220 and the rear transverse bar 1225 each comprise two portions that allow the outer ends 1230 of both the front transverse bar 1220 and the rear transverse bar 1225 to rotate via a hinge or folding bracket, with respect to the first lengthwise bar 1210 and the second lengthwise bar 1215 while folding at or about the longitudinal position 1235 (e.g., may be centrally located or offset) of the front transverse bar 1220 and the rear transverse bar 1225.

Figure 14:
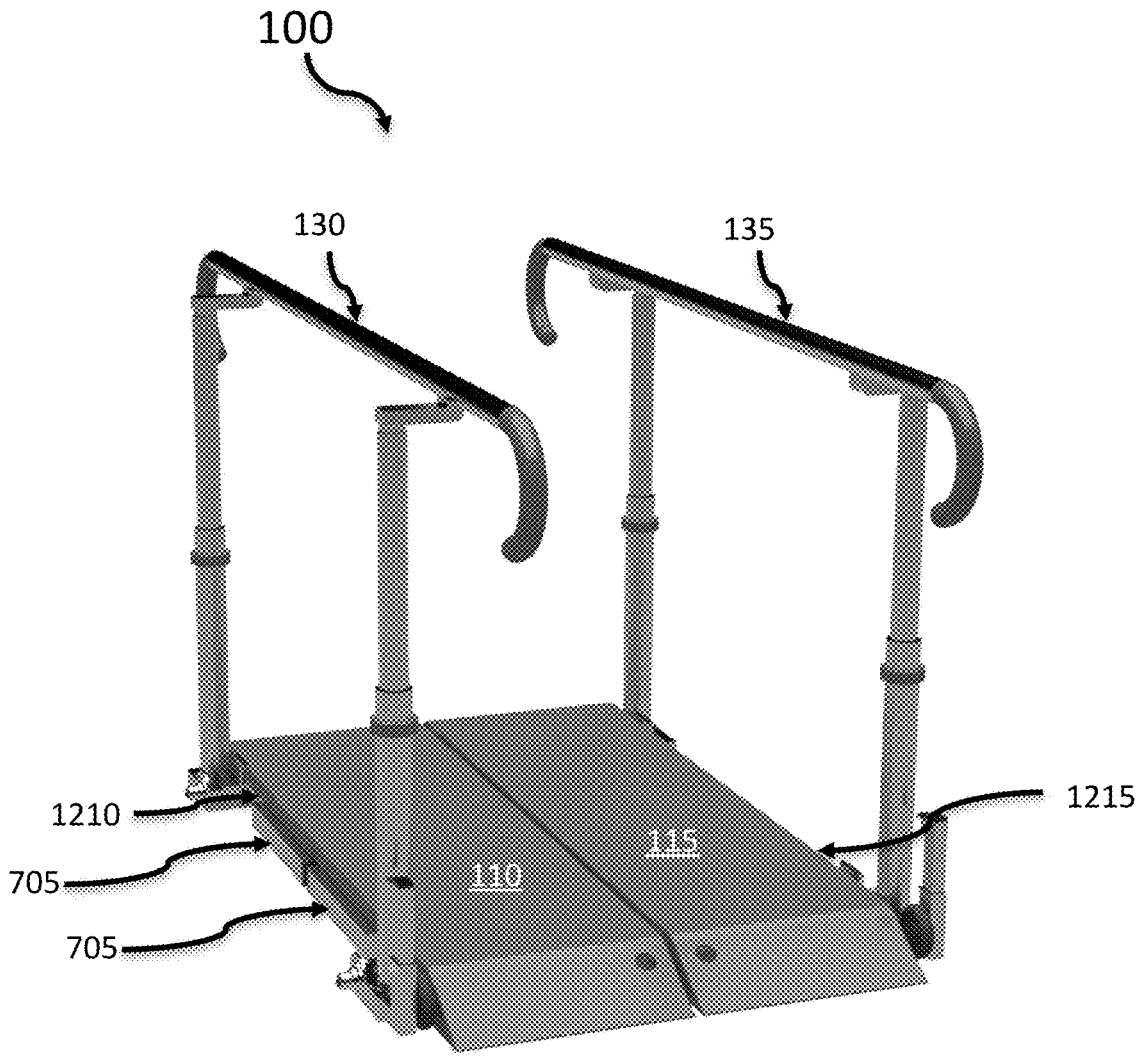
FIG. 14 illustrates a perspective view of the embodiment of FIG. 1 with one or more supports in a folded configuration.
Figure 15:
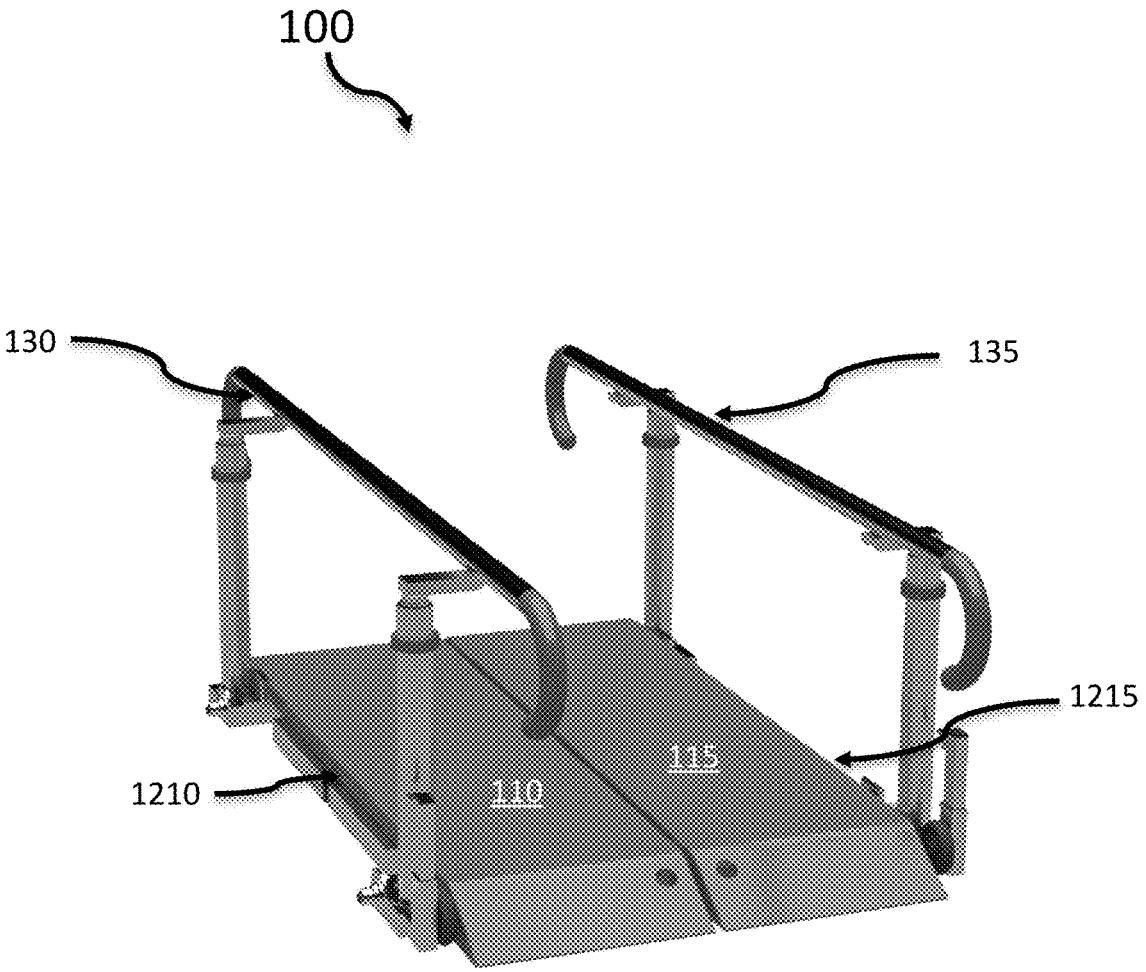
FIG. 15 illustrates a perspective view of the embodiment of FIG. 1 with the handrails in a lowered position.
Figure 16:
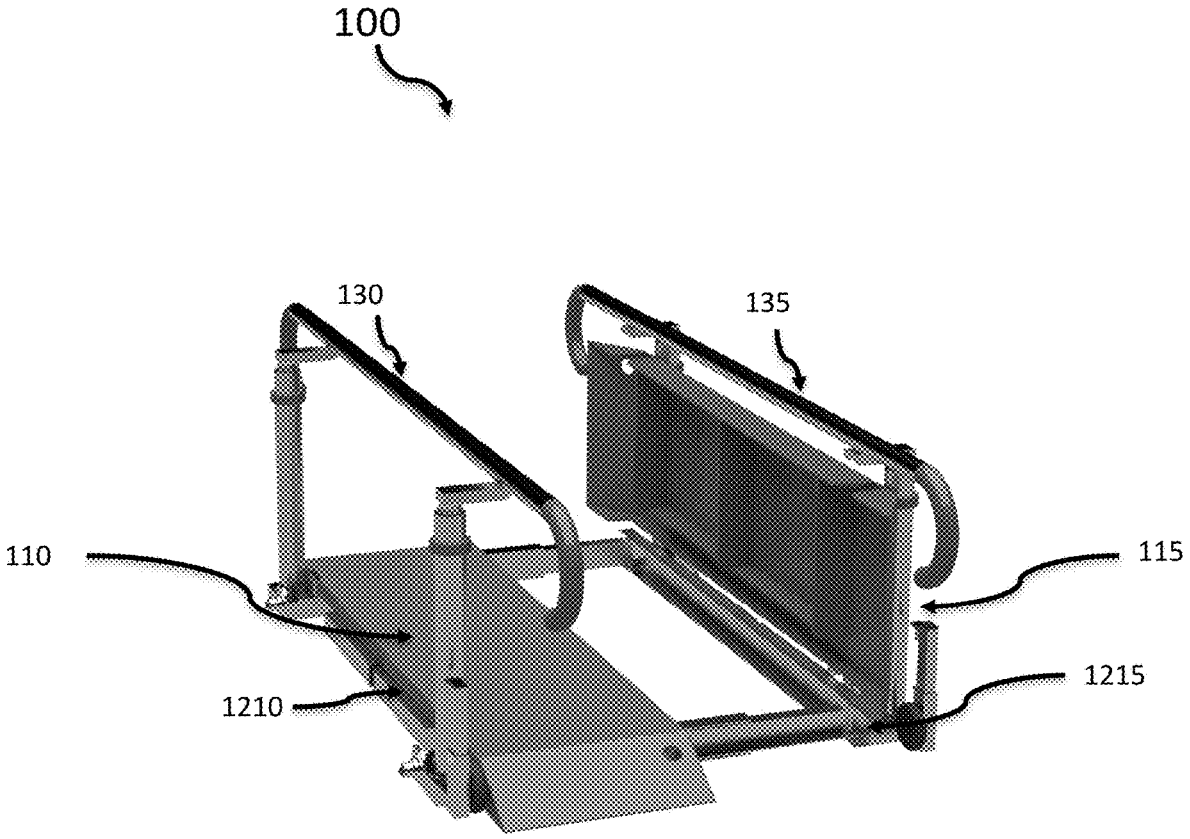
FIG. 16 illustrates a perspective view of the embodiment of FIG. 1 with one or more base panels raised in an upward position.
Figure 17:
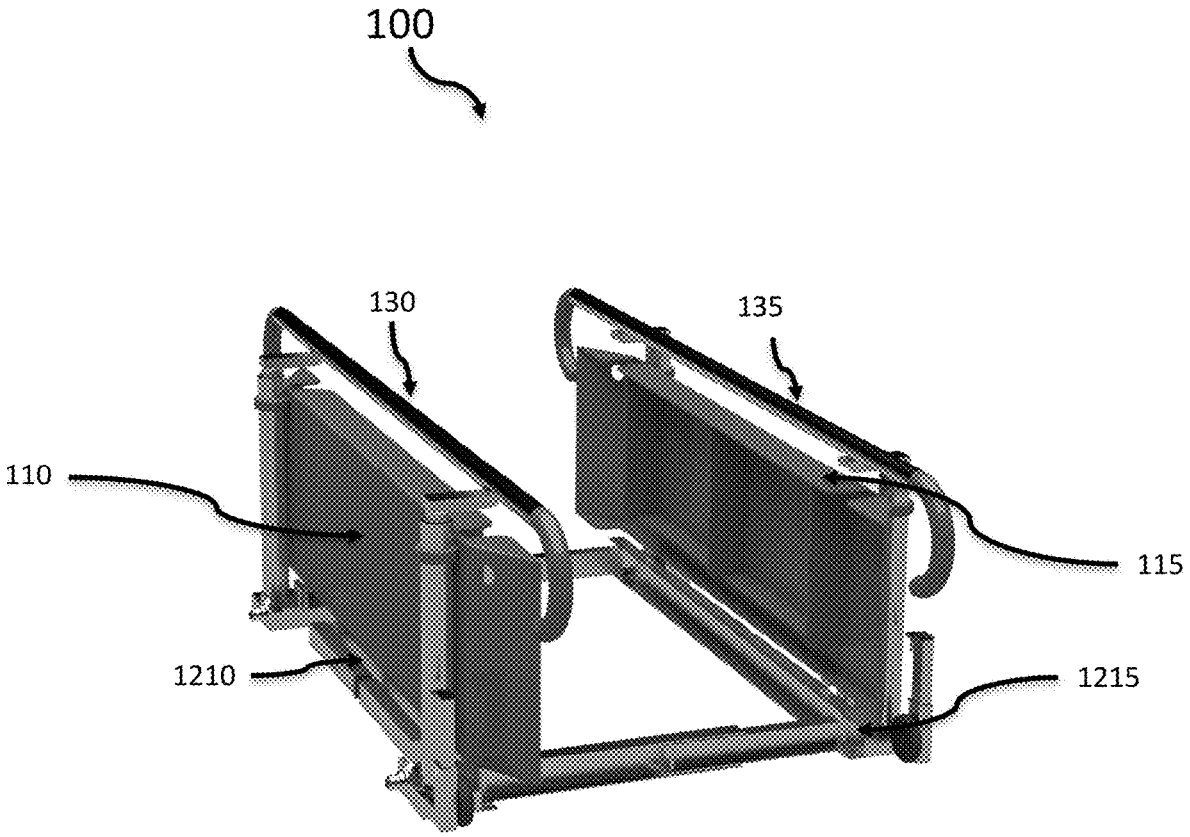
FIG. 17 illustrates a perspective view of the embodiment of FIG. 1 with one or more base panels raised in an upward position.
Figure 25A:
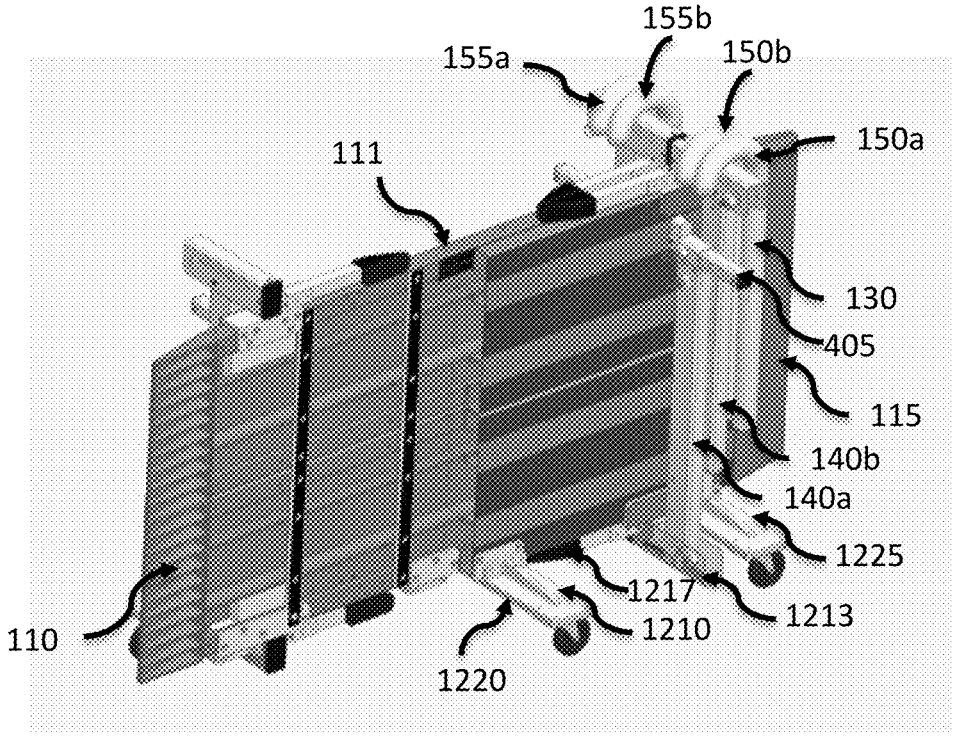
FIG. 25A illustrates a perspective view of an embodiment of a portable physical therapy device in a partially unfolded configuration.
Figure 25B:
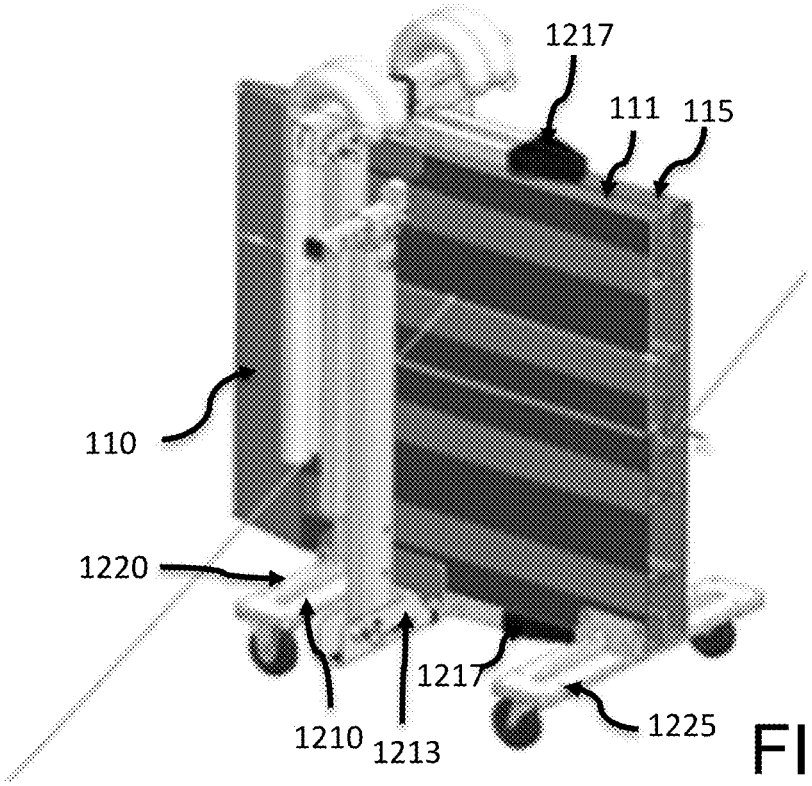
FIG. 25B illustrates a perspective view of the embodiment of FIG. 25A in a folded configuration.

FIGS. 13-23 illustrate one embodiment of the portable parallel bar device being adjusted from an unfolded (erected for use) configuration into a retracted or folded configuration for portability. As shown in FIG. 13, the portable device 100 is erected and ready for retracting. FIG. 14 shows the stability supports 705 rotated inwardly abutting alongside the outer edges of the first lengthwise bar 1210 and the second lengthwise bar 1215 of the frame 1205. In some embodiments, the stability supports 705 can be held in place with magnets as previously described above or locking devices known in the art. In further embodiments, the stability supports 705 can be rotated inwardly in the vertical plane as described above. FIG. 15 shows the first handrail 130 and the second handrail 135 lowered into a lowered position, as described also with respect to FIG. 2. FIG. 16 shows a second base panel 115, having an edge rotatably connected to the second lengthwise bar 1215, being rotated into a folded configuration about the second lengthwise bar 1215. FIG. 17 shows a first base panel 110, having an edge rotatably connected to the first lengthwise bar 1210, being rotated into a folded configuration about the first lengthwise bar 1210. Both the first base panel 110 and the second base panel 115 are rotated upwards and may be secured into a folded position. In some embodiments, as shown in FIGS. 25A-25B. the first base panel 110 and the second base panel 115 are configured to hinge at an outer edge 111 that is rotatably connected to the front transverse bar 1220 and to the rear transverse bar 1225, respectively. In such embodiments, the first lengthwise bar 1210 and the second lengthwise bar 1215 are each configured to fold along its length a location 1217 (as opposed to the first and second transverse bars hinging as described elsewhere herein). In some embodiments, each of the first lengthwise bar 1210 and the second lengthwise bar 1215 may comprise a first and second portion such that two portions are adjacent to one another at position 1217 in the folded configuration (FIG. 25B) and separated from one another in the unfolded configuration (a partial unfolded configuration is shown in FIG. 25A). Further, a first set of stanchions 140*a* are configured to slide along the length of the base panels 110, 115 with a sliding assembly 1213 to position the first set of stanchions 140*a* in the unfolded configuration. As described elsewhere herein, one or more of the stanchions 140*a*, 140*b* may comprise a width extender 405 and a handle 150*a*, 150*b*, 155*a*, 155*b*.

Figure 18:
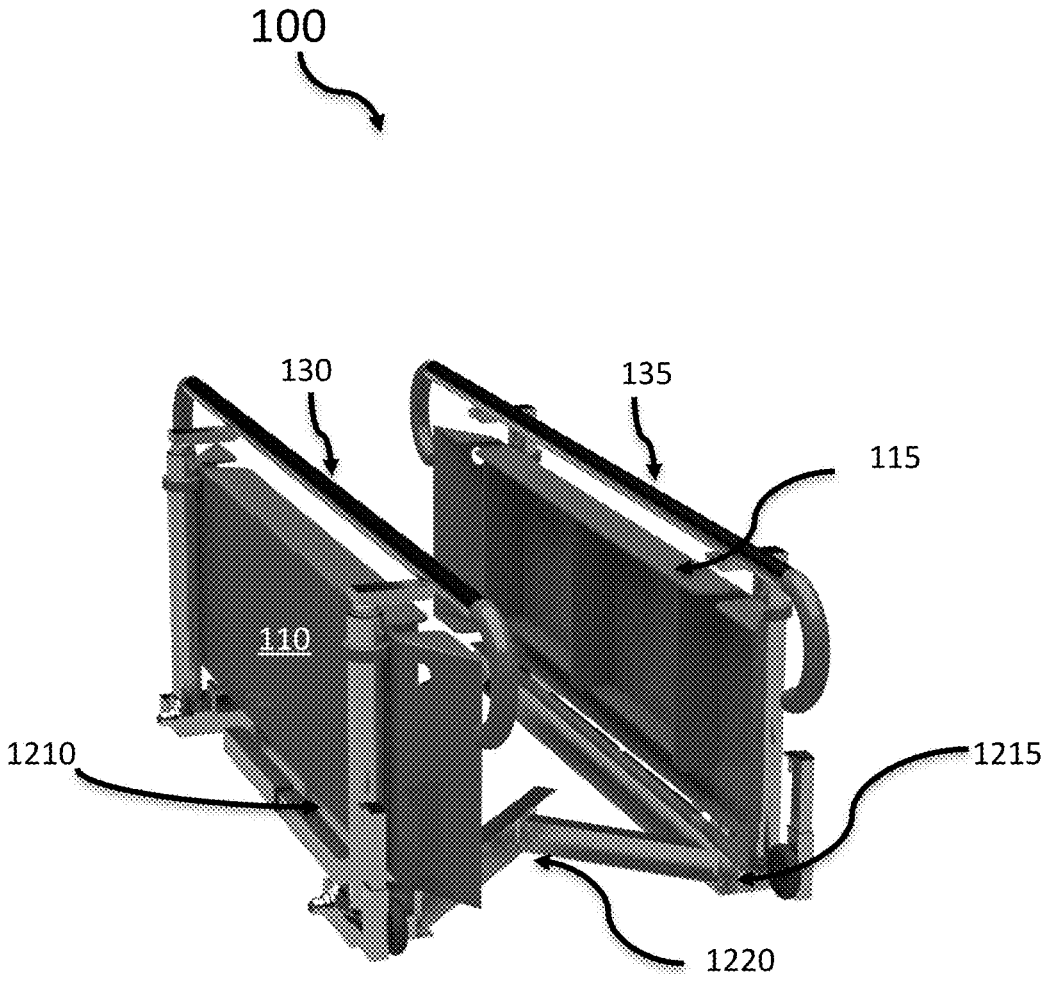
FIG. 18 illustrates a perspective view of the embodiment of FIG. 1 with one or more transverse bars of the frame in a partially folded configuration.
Figure 19:
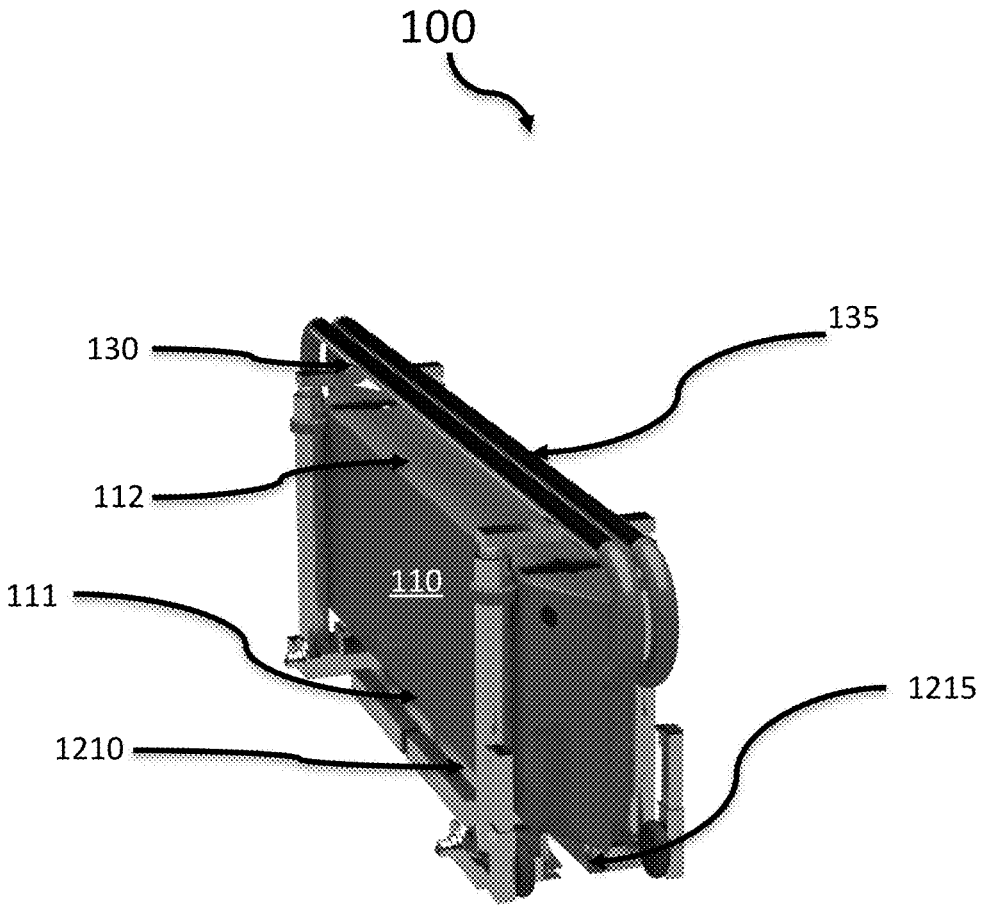
FIG. 19 illustrates a perspective view of the embodiment of FIG. 1 in a folded configuration.

In another non-limiting example, both the first base panel 110 and the second base panel 115 may be secured into the folded position using a cord, a locking clip, magnet, or the like. Both the first base panel 110 and the second base panel 115 may be rotated sequentially or substantially simultaneously. In embodiments having only one first base panel 110 or one second panel 115, the single panel may be rotated to form the storage or folded position. FIG. 18 shows both the front transverse bar 1220 and the rear transverse bar 1225 being folded inwardly about a longitudinal position (as described also with respect to FIG. 12), such that both the front transverse bar 1220 and the rear transverse bar 1225 include a hinge or similar mechanism. An outer end of both the front transverse bar 1220 and the rear transverse bar 1225 is coupled to the first lengthwise bar 1210 and the second lengthwise bar 1215 via a hinge or other mechanism known in the art, so that during the folding process, when the inner portion of both the front transverse bar 1220 and the rear transverse bar 1225 are pushed inwardly, the outer ends remain attached and rotate inwardly. The first lengthwise bar 1210 and the second lengthwise bar 1225 are then folded together as shown in FIG. 19. Said another way, each transverse bar 1220, 1225 comprises a scissor mechanism that causes the transverse bars 1220, 1225 to collapse towards a center region of the frame 1205. As shown in FIG. 19, in a folded position, an inner edge 112 of both the first base panel 110 and the second base panel 115 are rotated upwards and the outer edge 111 of the base panels are substantially supported by the first lengthwise bar 1210 and the second lengthwise bar 1215. As such, both the front transverse bar 1220 and the rear transverse bar 1225 are inwardly fold with respect to both the first lengthwise bar 1210 and the second lengthwise bar 1225. In such a folded configuration, each transverse bar may be substantially parallel to each lengthwise bar. In one non-limiting embodiment, the front transverse bar 1220 and the rear transverse bar 1225 have two portions or sides connected via a hinge so that, when pushed inwardly and folded, the one portion nests within the other portion.

Figure 20:
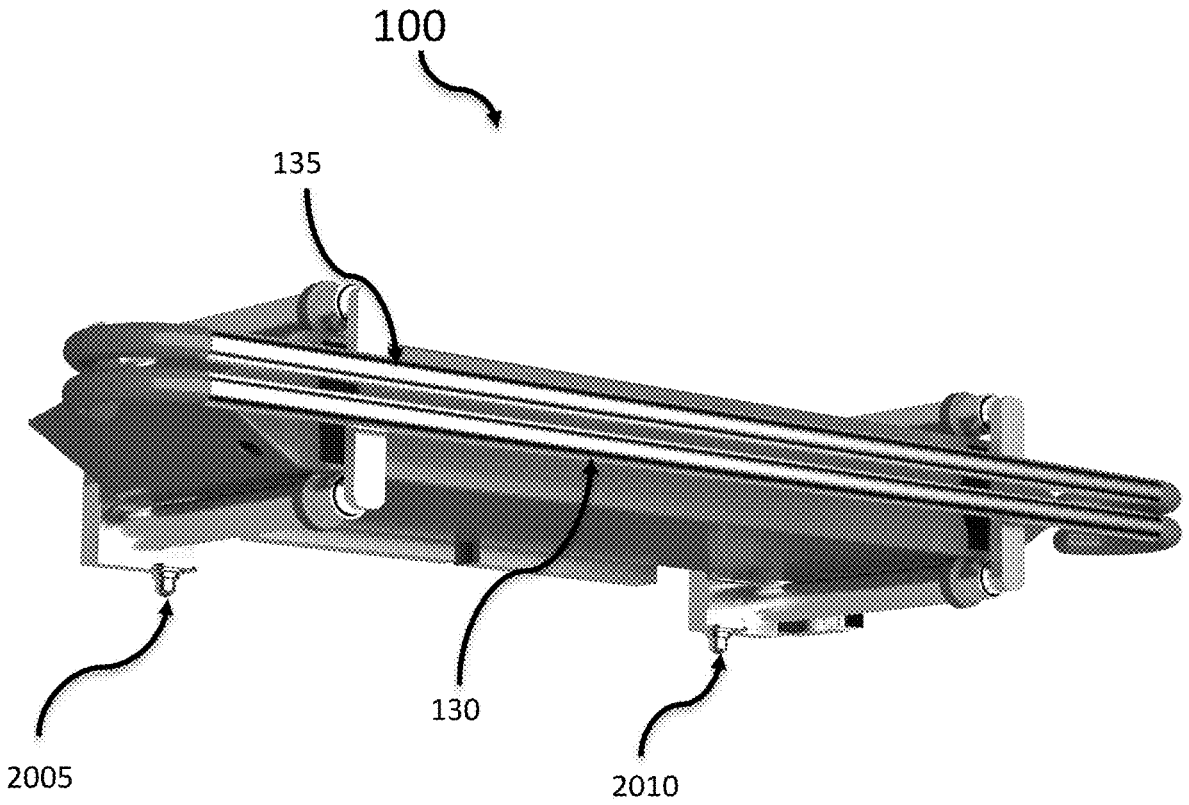
FIG. 20 illustrates a perspective view of the embodiment of FIG. 1 in a folded configuration and including a transport mechanism.
Figure 21:
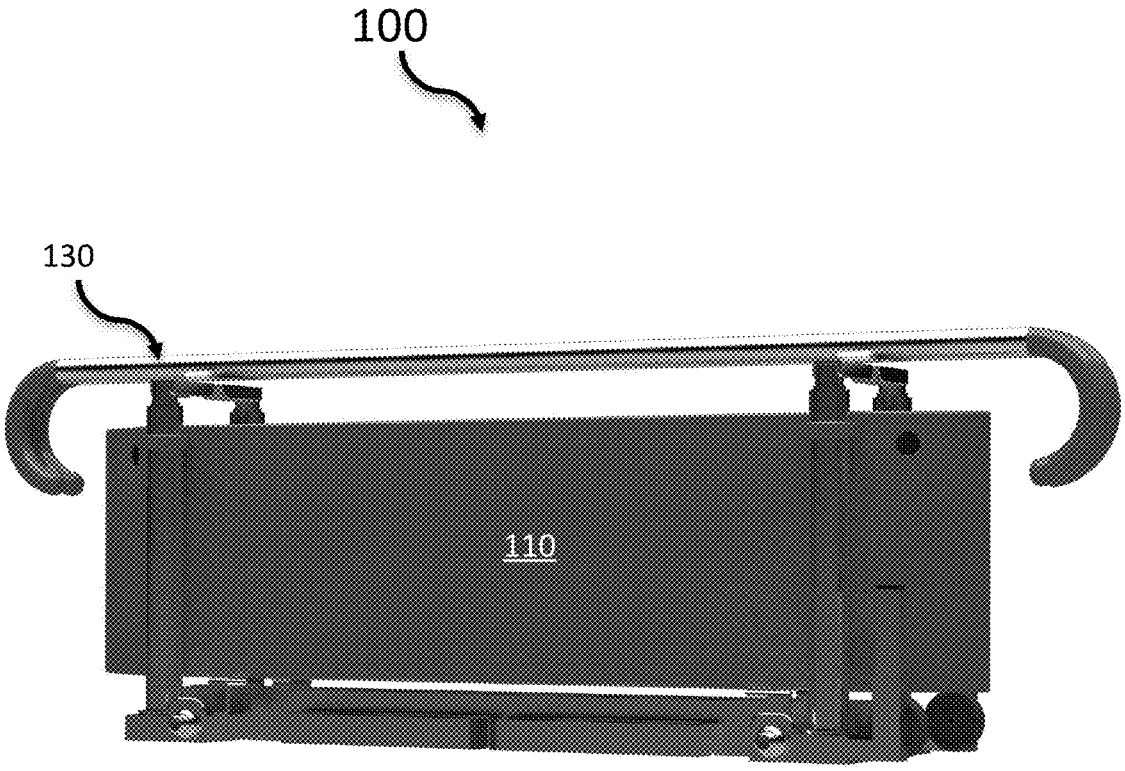
FIG. 21 illustrates a perspective view of the embodiment of FIG. 1 in a folded configuration.
Figure 22:
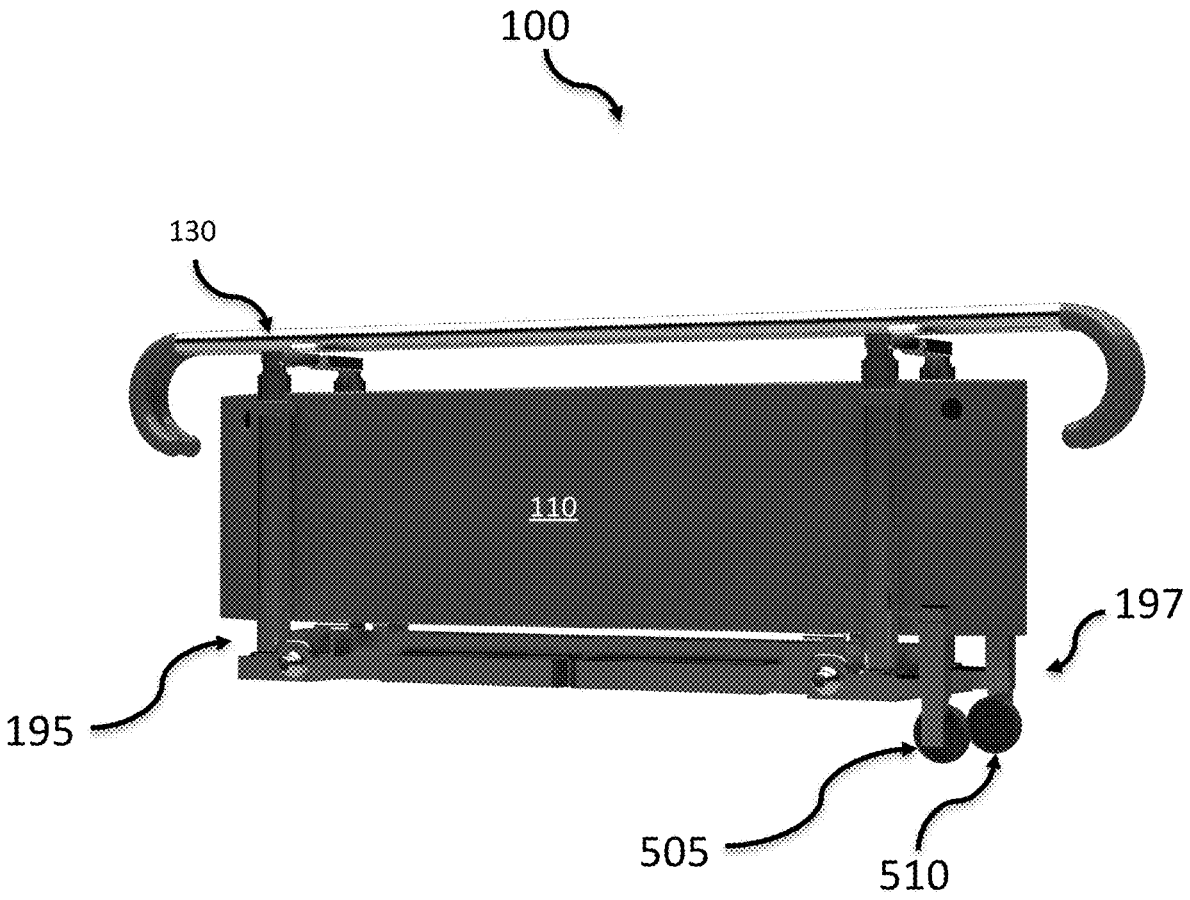
FIG. 22 illustrates a perspective view of the embodiment of FIG. 1 in a folded configuration and including a transport mechanism.
Figure 23:
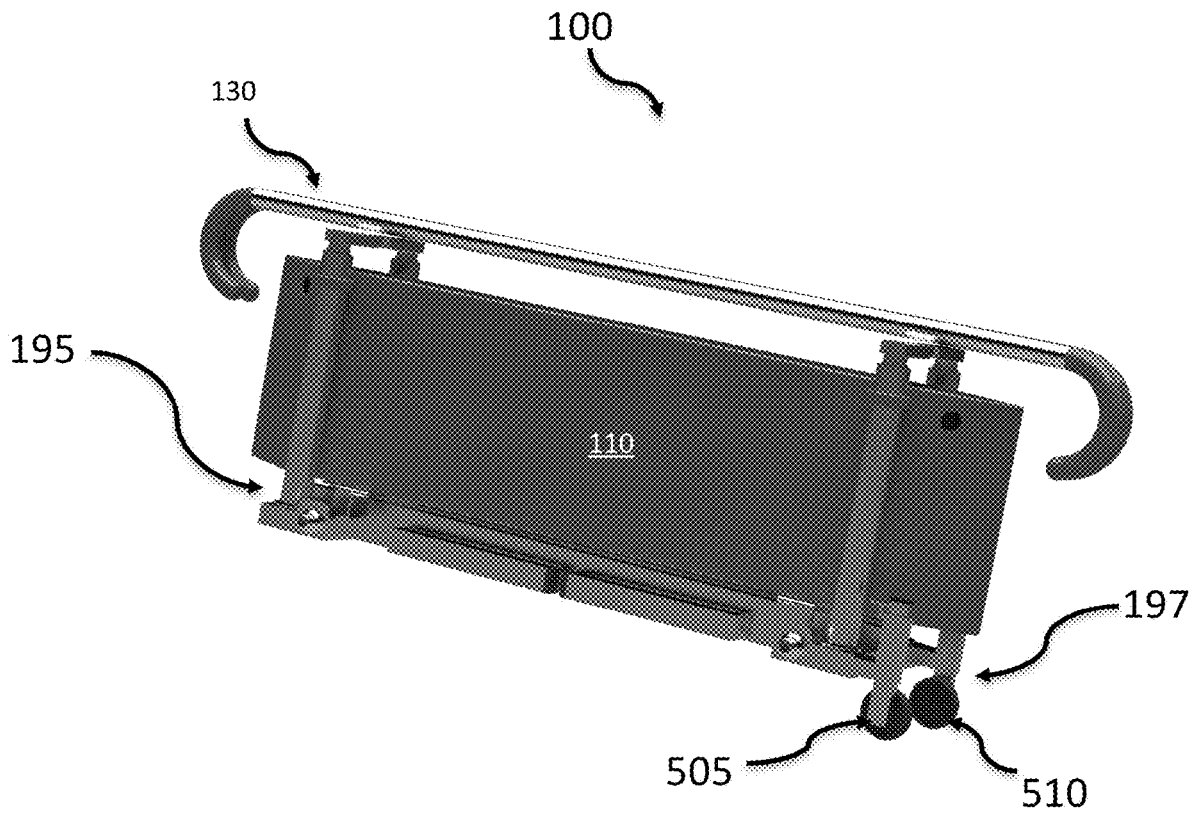
FIG. 23 illustrates a perspective view of the embodiment of FIG. 1 in a folded configuration and including a transport mechanism.

FIG. 20 shows a first caster 2005 and a second caster 2010 on one side of the frame 1205. In this manner, the folded device 100 may be stored horizontally and easily slid under a desk or a bed, for example. FIG. 21 shows the portable device 100 in the folded position allowing for easy transport by two individuals carrying the device 100 from both ends. Alternatively, FIG. 22 shows the portable device 100 configured to include the first wheel 505 and the second wheel 510 on one end and lowered to engage a surface for easy transporting by one individual, as shown in FIG. 23. Alternatively, with duplicates of both the first wheel 505 and the second wheel 510 placed on both the first end 197 and second end 195, ease of transport by one individual can be further facilitated.

As used in the description and claims, the singular form "a", "an" and "the" include both singular and plural references unless the context clearly dictates otherwise. For example, the term "number" may include, and is contemplated to include a plurality of holes. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a device, substance, or composition.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a system or method consisting essentially of the elements as defined herein would not exclude other materials, features, or steps that do not materially affect the basic and novel characteristic(s) of the claimed disclosure. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A physical therapy device capable of folding into a portable device, the physical therapy device comprising:

a frame comprising a first lengthwise bar and a second lengthwise bar; and a first transverse bar and a second transverse bar, wherein the frame is configured to be adjusted between an unfolded configuration for use and a folded configuration for storage, and wherein, in the unfolded configuration:

the first lengthwise bar is parallel to the second lengthwise bar, the first transverse bar is parallel to the second transverse bar, the first transverse bar is perpendicular to the first and second lengthwise bars, and the second transverse bar is perpendicular to the first and second lengthwise bars; and wherein, in the folded configuration:

the first lengthwise bar is parallel to the second lengthwise bar, the first transverse bar is configured to hinge at a first position along its length such that the first transverse bar folds towards a center region of the frame to be substantially parallel to the first and second lengthwise bars, and the second transverse bar is configured to hinge at a second position along its length, such that the second transverse bar folds towards the center region of the frame to be substantially parallel to the first and second lengthwise bars;

a first set of stanchions, each coupled to at least a portion of the first lengthwise bar; and a first handrail coupled to a top portion of each of the first set of stanchions.

2. The device of claim 1, further comprising a second set of stanchions, each coupled to at least a portion of the second lengthwise bar.

3. The device of claim 2, further comprising a second handrail coupled to a top portion of each of the second set of stanchions.

4. The device of claim 3, wherein the first handrail is parallel to the second handrail.

5. The device of claim 1, wherein one or more of the first set of stanchions is vertically adjustable.

6. The device of claim 5, wherein each of the first set of stanchions comprises an external member and an internal member such that the internal member is configured to slide within a lumen defined by the external member for the vertical adjustment.

7. The device of claim 1, further comprising a platform comprising at least one base panel, wherein the at least one base panel comprises an outer edge that is rotatably coupled to the first lengthwise bar.

8. The device of claim 7, wherein, in the unfolded configuration, the at least one base panel is configured to rest on the frame, such that the at least one base panel is parallel to the frame.

9. The device of claim 7, wherein, in the folded configuration, the at least one base panel is rotated toward the first set of stanchions, such that the outer edge of the at least one base panel is configured to rest on the first lengthwise bar.

10. The device of claim 1, wherein the first set of stanchions each comprises a width extender, such that the first handrail is configured to be adjusted relative to the first set of stanchions in a plane perpendicular to the first set of stanchions.

11. The device of claim 1, further comprising a wheel coupled to the frame, wherein the wheel is configured to be retracted toward the frame in the folded configuration and extended away from the frame in the unfolded configuration.

12. The device of claim 1, further comprising one or more stability supports operatively coupled to the first lengthwise bar.

13. The device of claim 12, wherein, in the unfolded configuration, the one or more stability supports are configured to extend from the frame to be substantially perpendicular to the first lengthwise bar.

14. A method of manipulating a portable physical therapy device between a folded configuration and an unfolded configuration, the method comprising:

erecting a first set of stanchions each coupled to at least a portion of a first lengthwise bar, wherein the first set of stanchions are coupled to a first handrail at a top portion of each stanchion; and unfolding a frame comprising:

unfolding a first transverse bar at a first position along its length such that the first transverse bar folds away from a center region of the frame to be substantially perpendicular to the first lengthwise bar, and unfolding a second transverse bar at a second position along its length such that the second transverse bar folds away from the center region of the frame to be substantially perpendicular to a second lengthwise bar, the second lengthwise bar being parallel to the first lengthwise bar.

15. The method of claim 14, further comprising erecting a second set of stanchions, each coupled to at least a portion of the second lengthwise and each having a top portion coupled to a second handrail.

16. The method of claim 14, further comprising vertically adjusting the first set of stanchions comprising an external member and an internal member such that the internal member is configured to slide within a lumen defined by the external member.

17. The method of claim 14, further comprising folding the frame, which comprises:

folding the first transverse bar at the first position along its length such that the first transverse bar folds toward the center region of the frame to be substantially parallel to the first and second lengthwise bars;

folding the second transverse bar at the second position along its length such that the second transverse bar folds toward the center region of the frame to be substantially parallel to the first and second lengthwise bars; and preserving the substantially parallel relationship between the first lengthwise bar and the second lengthwise bar.

18. The method of claim 17, further comprising rotating at least one base panel, comprising an outer edge that is rotatably coupled to the first lengthwise bar, to a position parallel to the first set of stanchions and is configured to rest upon the first lengthwise bar.

19. The method of claim 14, further comprising rotating at least one base panel, comprising an outer edge that is rotatably coupled to the first lengthwise bar, to a position substantially parallel to the frame; and resting the at least one base panel on the frame.

20. The method of claim 14, further comprising maneuvering at least one stability support, operatively coupled to the first lengthwise bar, outward and away from the first lengthwise bar.

* * * * *